US008037860B2

(12) United States Patent
Takami et al.

(10) Patent No.: US 8,037,860 B2
(45) Date of Patent: Oct. 18, 2011

(54) CYLINDER LINER AND ENGINE

(75) Inventors: Toshihiro Takami, Toyota (JP); Kouhei Hori, Aichi-ken (JP); Takeshi Tsukahara, Toyota (JP); Noritaka Miyamoto, Toyota (JP); Masaki Hirano, Toyota (JP); Yukinori Ohta, Nagoya (JP); Satoshi Yamada, Toyota (JP); Kouhei Shibata, Toyota (JP); Nobuyuki Yamashita, Shiojiri (JP); Toshihiro Mihara, Matsumoto (JP); Giichiro Saito, Yamagata (JP); Masami Horigome, Yamagata (JP); Takashi Sato, Yamagata (JP)

(73) Assignees: Toyota Jidosha Kabushiki Kaisha, Toyota-shi (JP); Teikoku Piston Ring Co., Ltd., Chiyoda-ku (JP); Teipi Industry Co., Ltd., Sagae-shi (JP)

( * ) Notice: Subject to any disclaimer, the term of this patent is extended or adjusted under 35 U.S.C. 154(b) by 219 days.

(21) Appl. No.: 11/481,083

(22) Filed: Jul. 6, 2006

(65) Prior Publication Data

US 2007/0012179 A1 Jan. 18, 2007

(30) Foreign Application Priority Data

Jul. 8, 2005 (JP) ..... 2005-201000

(51) Int. Cl.

| | |
|---|---|
| ***F02F 1/00*** | (2006.01) |
| ***F02F 3/00*** | (2006.01) |
| ***F02F 1/10*** | (2006.01) |
| ***F02B 75/08*** | (2006.01) |

(52) U.S. Cl. ..... 123/193.2; 123/193.1; 123/668

(58) Field of Classification Search ..... 123/668, 123/193.1–193.3; 29/888.061
See application file for complete search history.

(56) References Cited

U.S. PATENT DOCUMENTS

| | | | | |
|---|---|---|---|---|
| 1,955,292 | A * | 4/1934 | Heintz | 29/888.061 |
| 4,273,835 | A * | 6/1981 | Higuchi | 428/446 |
| 4,505,234 | A * | 3/1985 | Meiners | 123/41.84 |
| 5,097,807 | A * | 3/1992 | Oikawa et al. | 123/276 |
| 5,115,771 | A * | 5/1992 | Ozawa | 123/41.72 |
| 5,183,025 | A * | 2/1993 | Jorstad et al. | 123/669 |
| 5,537,969 | A * | 7/1996 | Hata et al. | 123/193.2 |
| 5,671,532 | A * | 9/1997 | Rao et al. | 29/888.061 |
| 6,044,820 | A * | 4/2000 | Domanchuk et al. | 123/193.2 |
| 6,286,583 | B1 | 9/2001 | Rueckert et al. | |
| 6,640,765 | B2 * | 11/2003 | Land et al. | 123/193.2 |

(Continued)

FOREIGN PATENT DOCUMENTS

DE 197 45 585 4/1998

(Continued)

OTHER PUBLICATIONS

International Search Report, PCT/JP2006/313924 dated Jul. 11, 2006.

(Continued)

*Primary Examiner* — Erick Solis
*Assistant Examiner* — Sizo Vilakazi
(74) *Attorney, Agent, or Firm* — Kenyon & Kenyon LLP

(57) ABSTRACT

A cylinder liner has an upper portion and a lower portion with respect to an axial direction of the cylinder liner. A high thermal conductive film is provided on an outer circumferential surface of the upper portion. A low thermal conductive film is provided on an outer circumferential surface of the lower portion. The cylinder liner reduces temperature difference of a cylinder along its axial direction.

36 Claims, 19 Drawing Sheets

U.S. PATENT DOCUMENTS

| | | | | |
|---|---|---|---|---|
| 7,104,240 | B1 * | 9/2006 | Vuk et al. | 123/193.2 |
| 7,191,770 | B1 * | 3/2007 | Anderson et al. | 123/668 |
| 7,513,236 | B2 * | 4/2009 | Miyamoto et al. | 123/193.2 |
| 2003/0000086 | A1 | 1/2003 | Fuganti et al. | |
| 2003/0056645 | A1 * | 3/2003 | Land et al. | 92/171.1 |
| 2007/0009669 | A1 * | 1/2007 | Miyamoto et al. | 427/446 |

FOREIGN PATENT DOCUMENTS

| | | | |
|---|---|---|---|
| DE | 100 02 440 | A1 | 8/2001 |
| DE | 103 47 510 | B3 | 4/2005 |
| JP | 61-028741 | | 2/1986 |
| JP | 62-052255 | | 4/1987 |
| JP | 63-018163 | | 1/1988 |
| JP | 02-187251 | | 7/1990 |
| JP | 2000-352350 | A | 12/2000 |
| JP | 2001-170755 | A | 6/2001 |
| JP | 2001-200751 | A | 7/2001 |
| JP | 2003-053508 | A | 2/2003 |
| JP | 2006-002606 | A | 1/2006 |
| WO | WO 01/58621 | A1 | 8/2001 |
| WO | WO 2005/038073 | A2 | 4/2005 |

OTHER PUBLICATIONS

Written Opinion of the International Searching Authority, PCT/JP2006/313924.

International Preliminary Report on Patentability, PCT/JP2006/313924.

* cited by examiner

| Basic Component | |
|---|---|
| T.C | 2.9 (% by mass) ~ 3.7 (% by mass) |
| Si | 1.6 (% by mass) ~ 2.8 (% by mass) |
| Mn | 0.5 (% by mass) ~ 1.0 (% by mass) |
| P | 0.05 (% by mass) ~ 0.4 (% by mass) |

| Auxiliary Component | |
|---|---|
| Cr | 0.05 (% by mass) ~ 0.4 (% by mass) |
| B | 0.03 (% by mass) ~ 0.08 (% by mass) |
| Cu | 0.3 (% by mass) ~ 0.5 (% by mass) |

* T.C represents Total Carbon

Irradiation of Laser Light

Placement of Test Piece

CYLINDER LINER AND ENGINE

BACKGROUND OF THE INVENTION

The present invention relates to a cylinder liner for insert casting used in a cylinder block, and an engine having the cylinder liner.

Cylinder blocks for engines with cylinder liners have been put to practical use. Cylinder liners are typically applied to cylinder blocks made of an aluminum alloy. As such a cylinder liner for insert casting, the one disclosed in Japanese Laid-Open Utility Model Publication No. 62-52255 is known.

In an engine, a temperature increase of the cylinders causes the cylinder bores to be thermally expanded. Further, the temperature in a cylinder varies among positions along the axial direction of the cylinder. Accordingly, the amount of deformation of the cylinder bore due to thermal expansion varies along the axial direction. Such variation in deformation amount of the cylinder bore increases the friction of the piston, which degrades the fuel consumption rate.

SUMMARY OF THE INVENTION

Accordingly, it is an objective of the present invention to provide a cylinder liner that reduces temperature difference of a cylinder along its axial direction, and an engine having the cylinder liner.

In accordance with the foregoing objective, one aspect of the present invention provides a cylinder liner for insert casting used in a cylinder block. The cylinder liner has an upper portion and a lower portion with respect to an axial direction of the cylinder liner. A high thermal conductive film is provided on an outer circumferential surface of the upper portion. A low thermal conductive film is provided on an outer circumferential surface of the lower portion. The high thermal conductive film functions to increase the thermal conductivity between the cylinder block and the cylinder liner. The low thermal conductive film functions to decrease the thermal conductivity between the cylinder block and the cylinder liner.

Another aspect of the present invention provides a cylinder liner for insert casting. The cylinder liner has an upper portion and a lower portion with respect to an axial direction of the cylinder liner. A thickness of the upper portion is less than a thickness of the lower portion.

A further aspect of the present embodiment provides an engine having either of the above cylinder liners.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

BEST MODE FOR CARRYING OUT THE INVENTION

First Embodiment

A first embodiment of the present invention will now be described with reference to FIGS. 1 to 19C.

Structure of Engine

Figure 1:
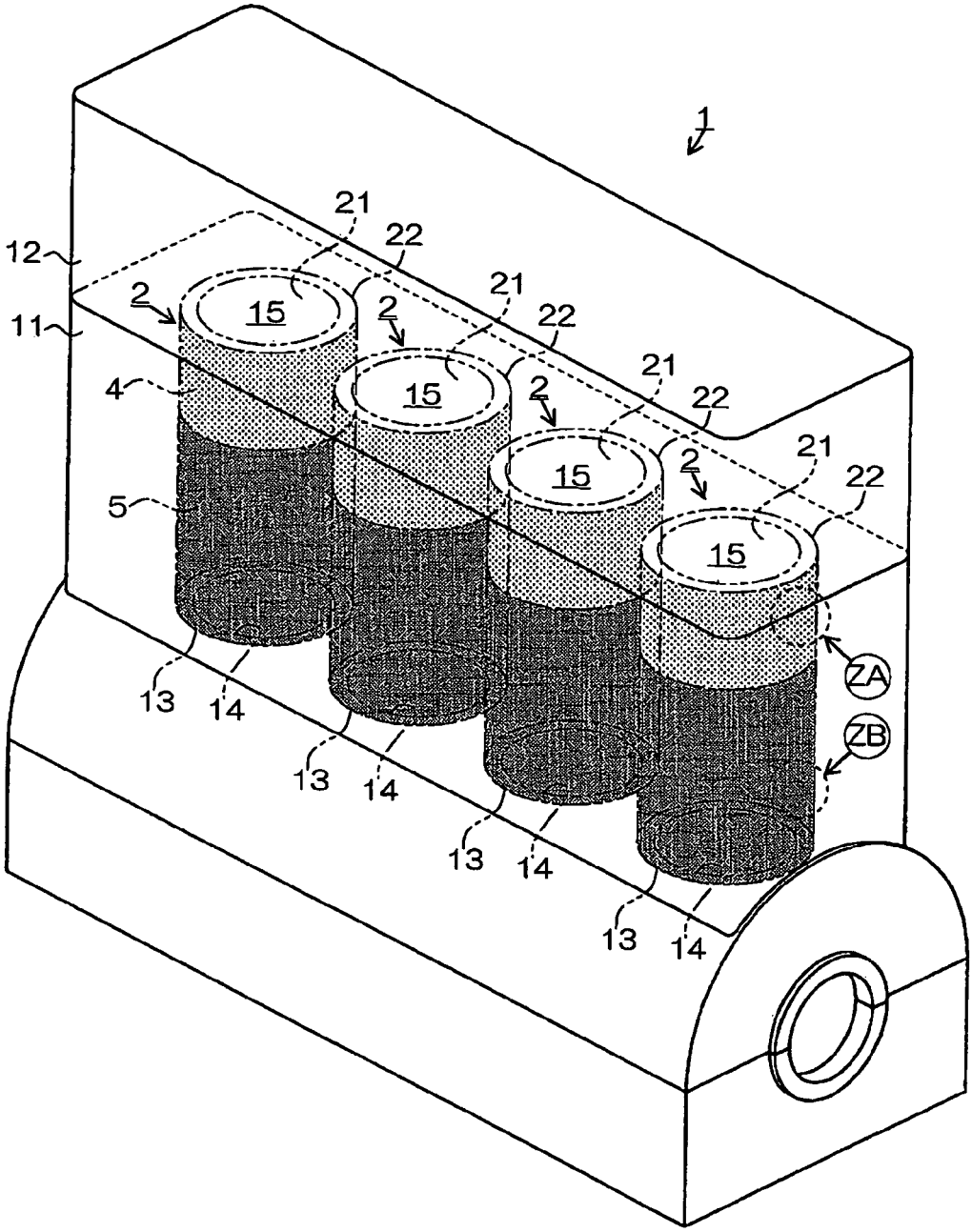
FIG. 1 is a schematic view illustrating an engine having cylinder liners according to a first embodiment of the present invention.

FIG. 1 shows the structure of an entire engine 1 made of an aluminum alloy having cylinder liners 2 according to the present embodiment.

The engine 1 includes a cylinder block 11 and a cylinder head 12. The cylinder block 11 includes a plurality of cylinders 13. Each cylinder 13 includes one cylinder liner 2.

The cylindrical liners 2 are formed in the cylinder block 11 by insert casting.

A liner inner circumferential surface 21, which is an inner circumferential surface of each cylinder liner 2, forms the inner wall of the corresponding cylinder 13 (cylinder inner wall 14) in the cylinder block 11. Each liner inner circumferential surface 21 defines a cylinder bore 15.

Through the insert casting of a casting material, a liner outer circumferential surface 22, which is an outer circumferential surface of each cylinder liner 2, is brought into contact with the cylinder block 11.

As the aluminum alloy as the material of the cylinder block 11, for example, an alloy specified in Japanese Industrial Standard (JIS) ADC10 (related United States standard, ASTM A380.0) or an alloy specified in JIS ADC12 (related United States standard, ASTM A383.0) may be used. In the present embodiment, an aluminum alloy of ADC12 is used for forming the cylinder block 11.

Structure of Cylinder Liner

Figures 2, 3:
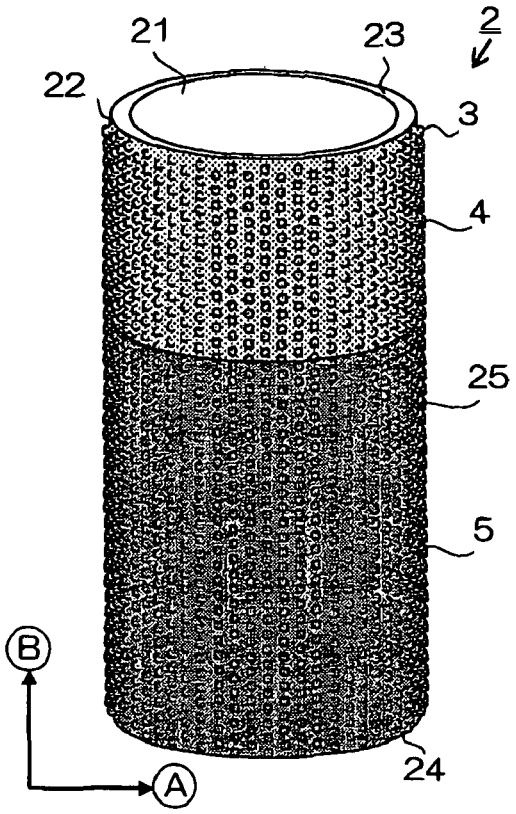
FIG. 2 is a perspective view illustrating the cylinder liner of the first embodiment.
FIG. 3 is a table showing one example of composition ratio of a cast iron, which is a material of the cylinder liner of the first embodiment.

FIG. 2 is a perspective view illustrating the cylinder liner 2 according to the present embodiment.

The cylinder liner 2 is made of cast iron. The composition of the cast iron is set, for example, as shown in FIG. 3. Basically, the components listed in table "Basic Component" may be selected as the composition of the cast iron. As necessary, components listed in table "Auxiliary Component" may be added.

The liner outer circumferential surface 22 of the cylinder liner 2 has projections 3, each having a constricted shape.

The projections 3 are formed on the entire liner outer circumferential surface 22 from a liner upper end 23, which is an upper end of the cylinder liner 2, to a liner lower end 24, which is a lower end of the cylinder liner 2. The liner upper end 23 is an end of the cylinder liner 2 that is located at a combustion chamber in the engine 1. The liner lower end 24 is an end of the cylinder liner 2 that is located at a portion opposite to the combustion chamber in the engine 1.

In the cylinder liner 2, a high thermal conductive film 4 and a low thermal conductive film 5 are formed on the liner outer circumferential surface 22. The high thermal conductive film 4 and the low thermal conductive film 5 are each formed along the entire circumferential direction of the cylinder liner 22.

More specifically, the high thermal conductive film 4 is formed on the liner outer circumferential surface 22 in a section from the liner upper end 23 to a liner middle portion 25, which is a middle portion of the cylinder liner 2 in the axial direction of the cylinder 13. The low thermal conductive film 5 is formed on the liner outer circumferential surface 22 in a section from the liner middle portion 25 to the liner lower end 24. That is, an interface of the high thermal conductive film 4 and the low thermal conductive film 5 is formed on the liner outer circumferential surface 22 in the liner middle portion 25.

The high thermal conductive film 4 is formed of an aluminum alloy sprayed layer 41. In the present embodiment, an Al—Si alloy is used as the aluminum alloy forming the sprayed layer 41.

The low thermal conductive film 5 is formed of a ceramic material sprayed layer 51. In the present embodiment, alumina is used as the ceramic material forming the sprayed layer 51. The sprayed layers 41, 51 are formed by spraying (plasma spraying, arc spraying, or HVOF spraying).

As the material for the high thermal conductive film 4, a material that meets at least one of the following conditions (A) and (B) may be used.

(A) A material the melting point of which is lower than or equal to a reference temperature TC, which is the temperature of the molten casting material, or a material containing such a material. More specifically, the reference temperature TC can be described as below. That is, the reference temperature TC refers to the temperature of the molten casting material of the cylinder block 11 when the molten casting material is supplied to a mold for performing the insert casting of the cylinder liners 2.

(B) A material that can be metallurgically bonded to the casting material of the cylinder block 11, or a material containing such a material.

Structure of Projections

Figure 4:
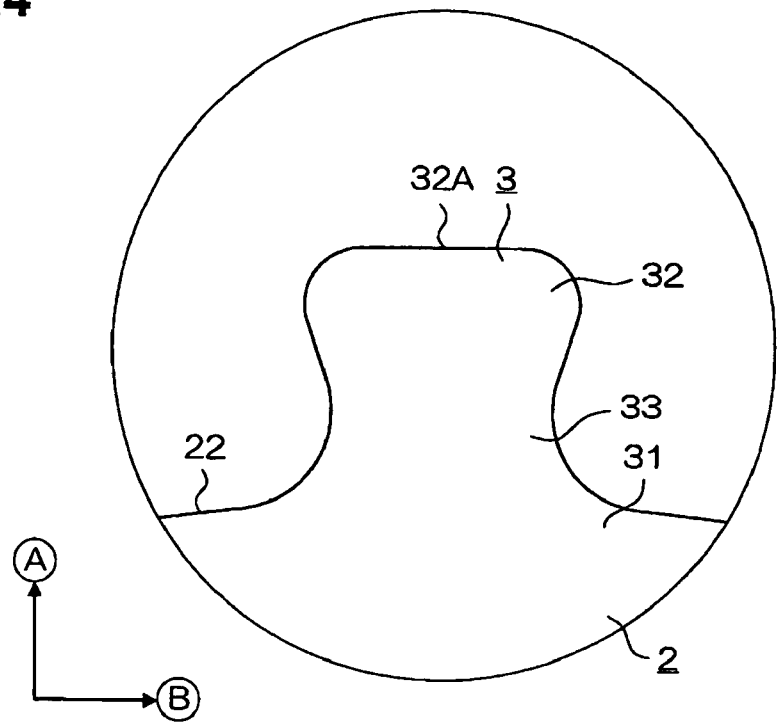
FIGS. 4 and 5 are model diagrams showing a projection having a constricted shape formed on the cylinder liner of the first embodiment.

FIG. 4 is a model diagram showing a projection 3. Hereafter, a direction of arrow A, which is a radial direction of the cylinder liner 2, is referred to as an axial direction of the projection 3. Also, a direction of arrow B, which is the axial direction of the cylinder liner 2, is referred to as a radial direction of the projection 3. FIG. 4 shows the shape of the projection 3 as viewed in the radial direction of the projection 3.

The projection 3 is integrally formed with the cylinder liner 2. The projection 3 is coupled to the liner outer circumferential surface 22 at a proximal end 31. At a distal end 32 of the projection 3, a top surface 32A that corresponds to a distal end surface of the projection 3 is formed. The top surface 32A is substantially flat.

In the axial direction of the projection 3, a constriction 33 is formed between the proximal end 31 and the distal end 32.

The constriction 33 is formed such that its cross-sectional area along the axial direction of the projection 3 (axial direction cross-sectional area SR) is less than an axial direction cross-sectional area SR at the proximal end 31 and at the distal end 32.

The projection 3 is formed such that the axial direction cross-sectional area SR gradually increases from the constriction 33 to the proximal end 31 and to the distal end 32.

Figure 5:
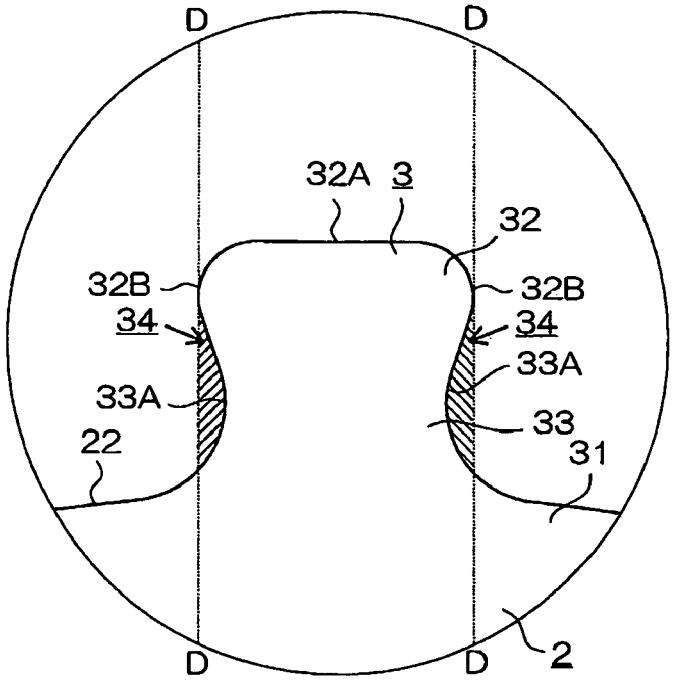

FIG. 5 is a model diagram showing the projection 3, in which a constriction space 34 of the cylinder liner 2 is marked. In each cylinder liner 2, the constriction 33 of each projection 3 creates the constriction space 34 (shaded areas in FIG. 5).

The constriction space 34 is a space surrounded by an imaginary cylindrical surface circumscribing a largest distal portion 32B (in FIG. 5, straight lines D-D corresponds to the cylindrical surface) and a constriction surface 33A, which is the surface of the constriction 33. The largest distal portion 32B represents a portion at which the diameter of the projection 3 is the longest in the distal end 32.

In the engine 1 having the cylinder liners 2, the cylinder block 11 and the cylinder liners 2 are bonded to each other with part of the cylinder block 11 located in the constriction spaces 34, in other words, with the cylinder block 11 engaged with the projections 3. Therefore, sufficient liner bond strength, which is the bond strength of the cylinder block 11 and the cylinder liners 2, is ensured. Also, since the increased liner bond strength suppresses deformation of the cylinder bores 15, the friction is reduced. Accordingly, the fuel consumption rate is improved.

Formation of Films

Figure 6B:
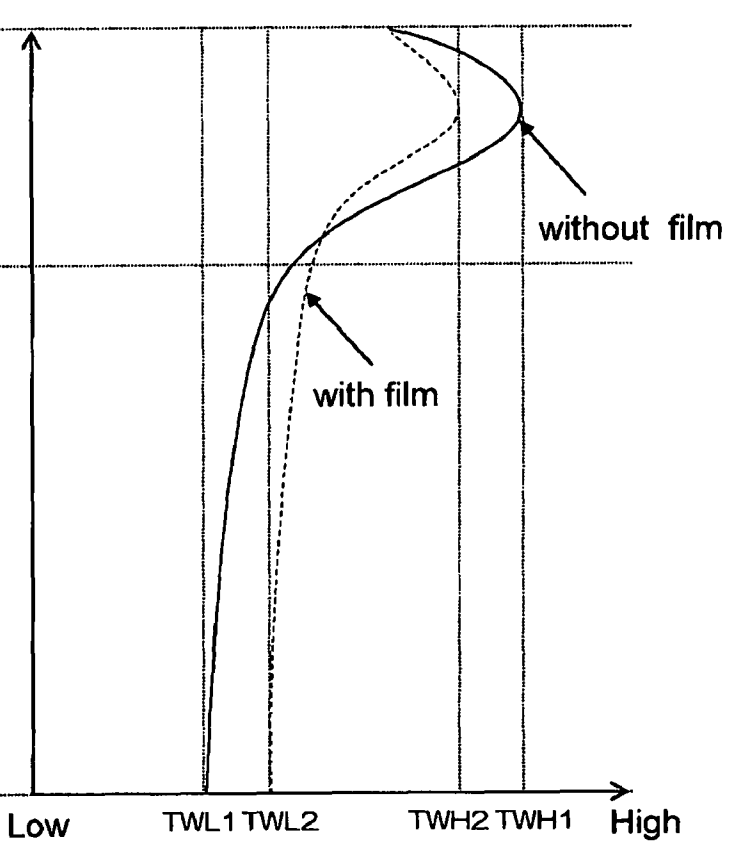
FIG. 6B is a graph showing one example of the relationship between axial positions and the temperature of the cylinder wall in the cylinder liner according to the first embodiment.
Figure 6A:
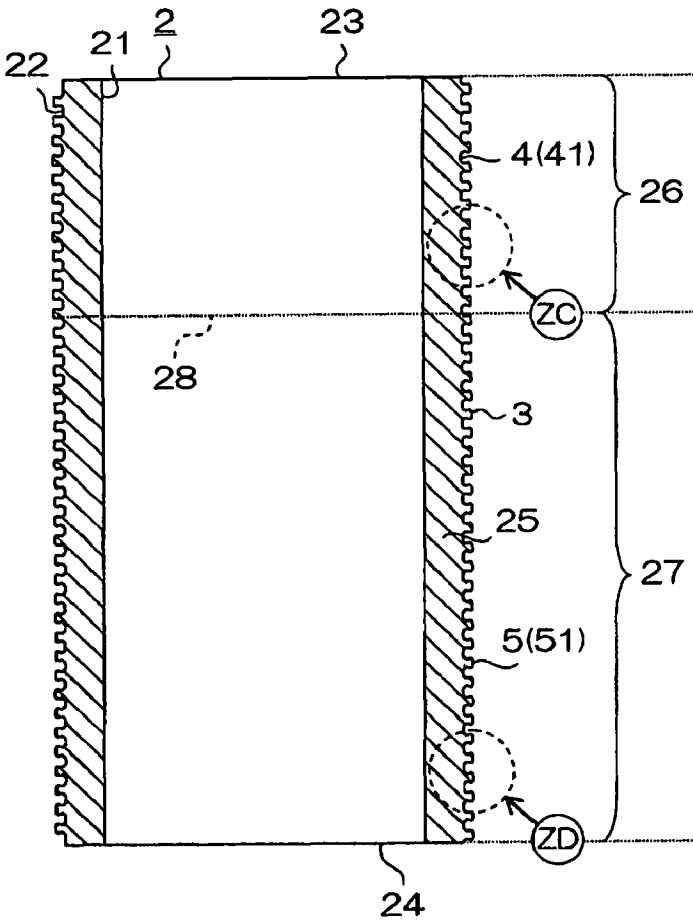
FIG. 6A is a cross-sectional view of the cylinder liner according to the first embodiment taken along the axial direction.
Figure 7:
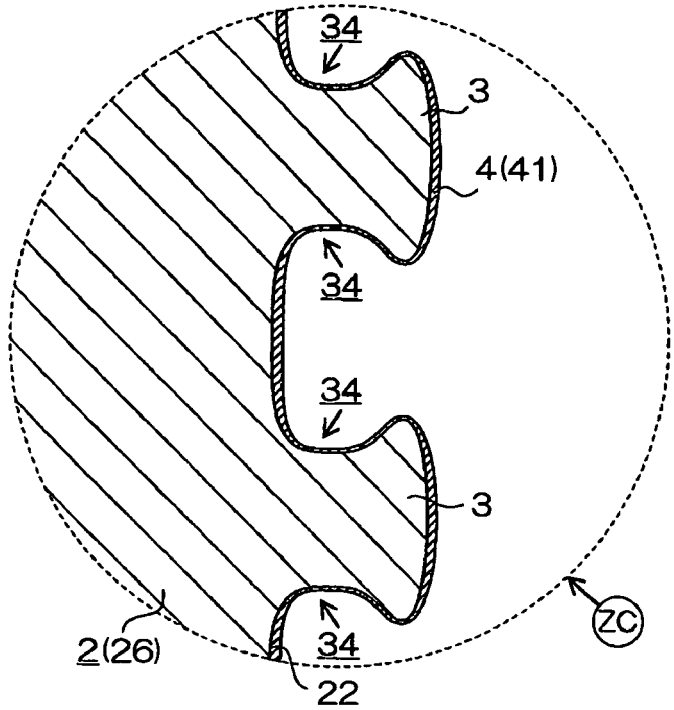
FIG. 7 is an enlarged cross-sectional view of the cylinder liner according to the first embodiment, showing encircled part ZC of FIG. 6A.

Referring to FIGS. 6A, 6B and 7, the formation of the high thermal conductive film 4 and the low thermal conductive film 5 in the cylinder liner 2 will be described. Hereafter, the thickness of the high thermal conductive film 4 and the thickness of the low thermal conductive film 5 are both referred to as a film thickness TP.

[1] Position of Films

Referring to FIGS. 6A and 6B, positions of the high thermal conductive film 4 and the low thermal conductive film 5 will be described. FIG. 6A is a cross-sectional view of the cylinder liner 2 along the axial direction. FIG. 6B shows one example of variation in the temperature of the cylinder 13 in a normal operating state of the engine 1, specifically, in the cylinder wall temperature TW. Hereafter, the cylinder liner 2 from which the high thermal conductive film 4 and the low thermal conductive film 5 are removed will be referred to as a reference cylinder liner. An engine having the reference cylinder liners will be referred to as a reference engine.

In this embodiment, the positions of the high thermal conductive film 4 and the low thermal conductive film 5 are determined based on the cylinder wall temperature TW in the reference engine.

The variation of the cylinder wall temperature TW will be described. In FIG. 6B, the solid line represents the cylinder wall temperature TW of the reference engine, and the broken line represents the cylinder wall temperature TW of the engine 1 of the present embodiment. Hereafter, the highest temperature of the cylinder wall temperature TW is referred to as a maximum cylinder wall temperature TWH, and the lowest temperature of the cylinder wall temperature TW will be referred to as a minimum cylinder wall temperature TWL.

In the reference engine, the cylinder wall temperature TW varies in the following manner.

(a) In an area from the liner lower end 24 to the liner middle portion 25, the cylinder wall temperature TW gradually increases from the liner lower end 24 to the liner middle portion 25 due to a small influence of combustion gas. In the vicinity of the liner lower end 24, the cylinder wall temperature TW is a minimum cylinder wall temperature TWL1. A portion of the cylinder liner 2 in which the cylinder wall temperature TW varies in such a manner is referred to as a low temperature liner portion 27.

(b) In an area from the liner middle portion 25 to the liner upper end 23, the cylinder wall temperature TW sharply increases due to a large influence of combustion gas. In the vicinity of the liner upper end 23, the cylinder wall temperature TW is a maximum cylinder wall temperature TWH1. A portion of the cylinder liner 2 in which the cylinder wall temperature TW varies in such a manner is referred to as a high temperature liner portion 26.

In combustion engines including the above described reference engine, an increase in the cylinder wall temperature TW causes thermal expansion of the cylinder bores. Since the cylinder wall temperature TW varies along the axial direction, the amount of deformation of the cylinder bore varies along the axial direction. Such variation in deformation amount of a cylinder increases the friction of the piston, which degrades the fuel consumption rate.

Thus, in each of the cylinder liner 2 according to the present embodiment, the high thermal conductive film 4 is formed on the liner outer circumferential surface 22 in the high temperature liner portion 26, the low thermal conductive film 5 is formed on the liner outer circumferential surface 22 in the low temperature liner portion 27. This configuration reduces the difference between the cylinder wall temperature TW in the high temperature liner portion 26 and the cylinder wall temperature TW in the low temperature liner portion 27.

In the engine 1 according to the present embodiment, sufficient adhesion between the cylinder block 11 and the high temperature liner portions 26 is established, that is, little gap is created about each high temperature liner portion 26. This ensures a high thermal conductivity between the cylinder block 11 and the high temperature liner portions 26. Accordingly, the cylinder wall temperature TW in the high temperature liner portion 26 is lowered. This causes the maximum cylinder wall temperature TWH to be a maximum cylinder wall temperature TWH2, which is lower than the maximum cylinder wall temperature TWH1.

In the engine 1, the low thermal conductive film 5 lowers the thermal conductivity between the cylinder block 11 and the low temperature liner portion 27. Accordingly, the cylinder wall temperature TW in the lower temperature liner portion 27 is increased. This causes the minimum cylinder wall temperature TWL to be a minimum cylinder wall temperature TWL2, which is higher than the minimum cylinder wall temperature TWL1.

In this manner, in the engine 1, a cylinder wall temperature difference ΔTW, which is the difference between the maximum cylinder wall temperature TWH and the minimum cylinder wall temperature TWL, is reduced. Accordingly, variation of deformation of each cylinder bore 15 along the axial direction of the cylinder 13 is reduced. In other words, the amount of deformation of the cylinder bore 15 is equalized. This reduces the friction, and thus improves the fuel consumption rate.

A wall temperature boundary 28, which is the boundary between the high temperature liner portion 26 and the low temperature liner portion 27, can be obtained based on the cylinder wall temperature TW of the reference engine. On the other hand, it has been found out that in many cases the length of the high temperature liner portion 26 (the length from the liner upper end 23 to the wall temperature boundary 28) is one third to one quarter of the entire length of the cylinder liner 2

(the length from the liner upper end 23 to the liner lower end 24). Therefore, when determining the position of the high thermal conductive film 4, one third to one quarter range from the liner upper end 23 in the entire liner length may be treated as the high temperature liner portion 26 without precisely determining the wall temperature boundary 28.

[2] Thickness of Films

In the cylinder liner 2, the high thermal conductive film 4 is formed such that its thickness TP is less than or equal to 0.5 mm. If the film thickness TP is greater than 0.5 mm, the anchor effect of the projections 3 will be reduced, resulting in a significant reduction in the bond strength between the cylinder block 11 and the high temperature liner portion 26.

In the present embodiment, the high thermal conductive film 4 is formed such that a mean value of the film thickness TP in a plurality of positions of the high temperature liner portion 26 is less than or equal to 0.5 mm. However, the high thermal conductive film 4 can be formed such that the film thickness TP is less than or equal to 0.5 mm in the entire high temperature liner portion 26.

In the engine 1, as the film thickness TP is reduced, the thermal conductivity between the cylinder block 11 and the high temperature liner portion 26 is increased. Thus, when forming the high thermal conductive film 4, it is preferable that the film thickness TP is made as close to zero as possible in the entire high temperature liner portion 26.

However, since, at the present time, it is difficult to form the sprayed layer 41 that has a uniform thickness over the entire high temperature liner portion 26, some areas on the high temperature liner portion 26 will be without the high thermal conductive film 4 if a target film thickness TP is set to an excessively small value when forming the high thermal conductive film 4. Thus, in the present embodiment, when forming the high thermal conductive film 4, the target film thickness TP is determined in accordance with the following conditions (A) and (B).

(A) The high thermal conductive film 4 can be formed on the entire high temperature liner portion 26.

(B) The minimum value in a range in which the condition (A) is met.

Therefore, the high thermal conductive film 4 is formed on the entire high temperature liner portion 26, and the film thickness TP of the high thermal conductive film 4 has a small value. Therefore, the thermal conductivity between the cylinder block 11 and the high temperature liner portion 26 is reliably increased. Although this embodiment focuses on increase in the thermal conductivity, the target film thickness TP is determined in accordance with other conditions when the cylinder wall temperature TW needs to be adjusted to a certain value.

In the cylinder liner 2, the low thermal conductive film 5 is formed such that its thickness TP is less than or equal to 0.5 mm. If the film thickness TP is greater than 0.5 mm, the anchor effect of the projections 3 will be reduced, resulting in a significant reduction in the bond strength between the cylinder block 11 and the low temperature liner portion 27.

In the present embodiment, the low thermal conductive film 5 is formed such that a mean value of the film thickness TP in a plurality of positions of the low temperature liner portion 27 is less than or equal to 0.5 mm. However, the low thermal conductive film 5 can be formed such that the film thickness TP is less than or equal to 0.5 mm in the entire low temperature liner portion 27.

[3] Formation of Films about Projections

FIG. 7 is an enlarged view showing encircled part ZC of FIG. 6A. In the cylinder liner 2, the high thermal conductive film 4 is formed on the liner outer circumferential surface 22 and the surfaces of the projections 3 such that the constriction spaces 34 are not filled. That is, when performing the insert casting of the cylinder liners 2, the casting material flows into the constriction spaces 34. If the constriction spaces 34 are filled by the high thermal conductive film 4, the casting material will not fill the constriction spaces 34. Thus, no anchor effect of the projections 3 will be obtained in the high temperature liner portion 26.

Figure 8:
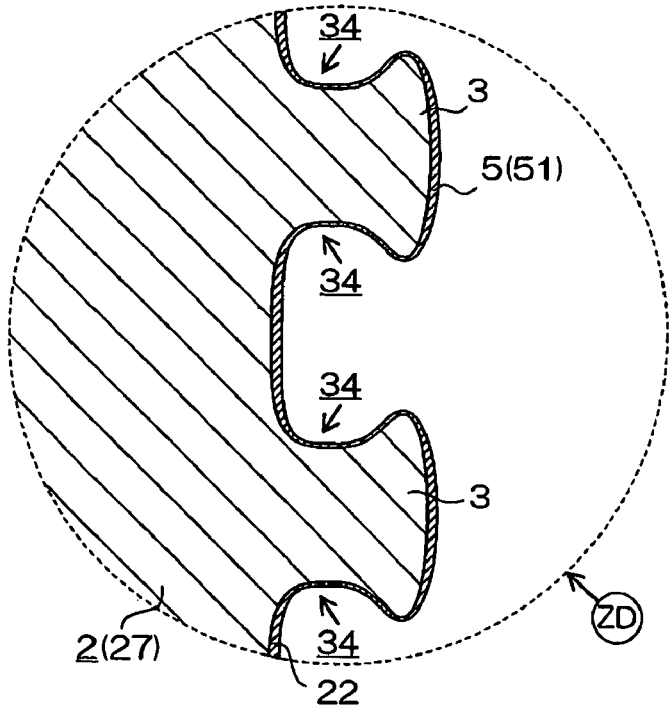
FIG. 8 is an enlarged cross-sectional view of the cylinder liner according to the first embodiment, showing encircled part ZD of FIG. 6A.

FIG. 8 is an enlarged view showing encircled part ZD of FIG. 6A. In the cylinder liner 2, the low thermal conductive film 5 is formed on the liner outer circumferential surface 22 and the surfaces of the projections 3 such that the constriction spaces 34 are not filled. That is, when performing the insert casting of the cylinder liners 2, the casting material flows into the constriction spaces 34. If the constriction spaces 34 are filled by the low thermal conductive film 5, the casting material will not fill the constriction spaces 34. Thus, no anchor effect of the projections 3 will be obtained in the low temperature liner portion 27.

Bonding State of Cylinder Block and Cylinder Liner

Figure 9:
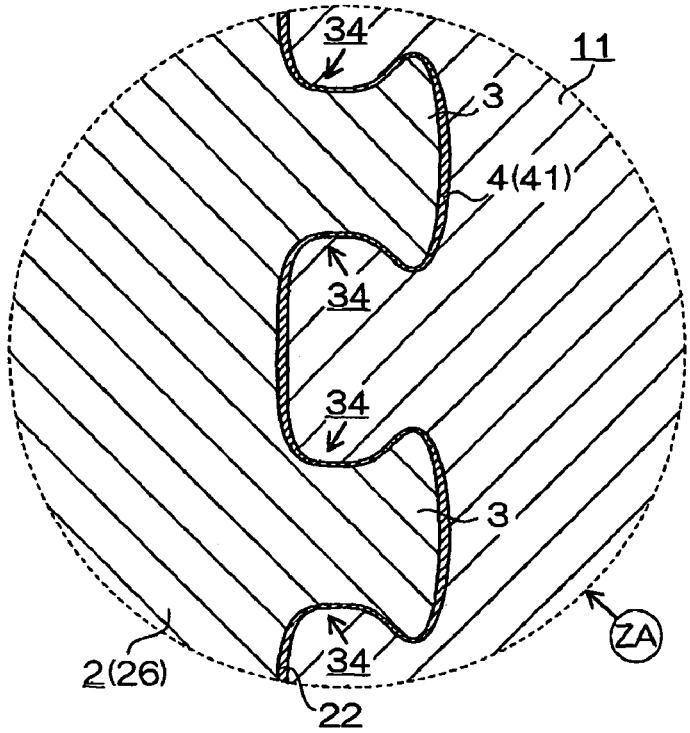
FIG. 9 is a cross-sectional view of the cylinder liner according to the first embodiment, showing encircled part ZA of FIG. 1.
Figure 10:
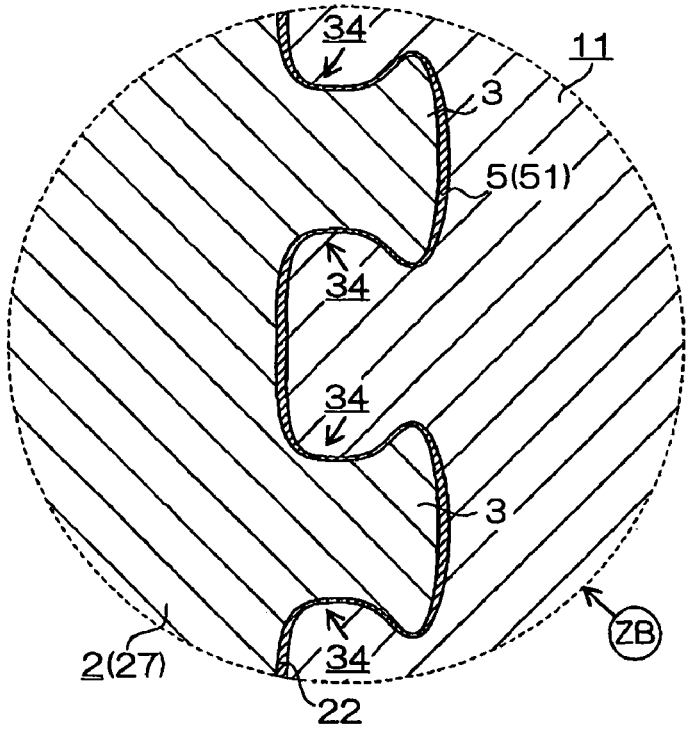
FIG. 10 is a cross-sectional view of the cylinder liner according to the first embodiment, showing encircled part ZB of FIG. 1.

Referring to FIGS. 9 and 10, the bonding state of the cylinder block 11 and the cylinder liner 2 will be described. FIGS. 9 and 10 are cross-sectional views showing the cylinder block 11 taken along the axis of the cylinder 13.

[1] Bonding State of High Temperature Liner Portion

FIG. 9 is a cross-sectional view of encircled part ZA of FIG. 1 and shows the bonding state between the cylinder block 11 and the high temperature liner portion 26. In the engine 1, the cylinder block 11 is bonded to the high temperature liner portion 26 in a state where the cylinder block 11 is engaged with the projections 3. The cylinder block 11 and the high temperature liner portion 26 are bonded to each other with the high thermal conductive film 4 in between.

Since the high thermal conductive film 4 is formed by spraying, the high temperature liner portion 26 and the high thermal conductive film 4 are mechanically bonded to each other with sufficient adhesion and bond strength. The adhesion of the high temperature liner portion 26 and the high thermal conductive film 4 is higher than the adhesion of the cylinder block and the reference cylinder liner in the reference engine.

The high thermal conductive film 4 is formed of an Al—Si alloy that has a melting point lower than the reference temperature TC and a high wettability with the casting material of the cylinder block 11. Thus, the cylinder block 11 and the high thermal conductive film 4 are mechanically bonded to each other with sufficient adhesion and bond strength. The adhesion of the cylinder block 11 and the high thermal conductive film 4 is higher than the adhesion of the cylinder block and the reference cylinder liner in the reference engine.

In the engine 1, since the cylinder block 11 and the high temperature liner portion 26 are bonded to each other in this state, the following advantages are obtained.

(A) Since the high thermal conductive film 4 ensures the adhesion between the cylinder block 11 and the high temperature liner portion 26, the thermal conductivity between the cylinder block 11 and the high temperature liner portion 26 is increased.

(B) Since the high thermal conductive film 4 ensures the bond strength between the cylinder block 11 and the high temperature liner portion 26, exfoliation of the cylinder block 11 and the high temperature liner portion 26 is suppressed. Therefore, even if the cylinder bore 15 is expanded, the adhesion of the cylinder block 11 and the high temperature liner portion 26 is maintained. This suppresses the reduction in the thermal conductivity.

(C) Since the projections 3 ensures the bond strength between the cylinder block 11 and the high temperature liner portion 26, exfoliation of the cylinder block 11 and the high temperature liner portion 26 is suppressed. Therefore, even if the cylinder bore 15 is expanded, the adhesion of the cylinder block 11 and the high temperature liner portion 26 is maintained. This suppresses the reduction in the thermal conductivity.

In the engine 1, as the adhesion between the cylinder block 11 and the high thermal conductive film 4 and the adhesion between the high temperature liner portion 26 and the high thermal conductive film 4 are lowered, the amount of gap between these components is increased. Accordingly, the thermal conductivity between the cylinder block 11 and the high temperature liner portion 26 is reduced. As the bond strength between the cylinder block 11 and the high thermal conductive film 4 and the bond strength between the high temperature liner portion 26 and the high thermal conductive film 4 are reduced, it is more likely that exfoliation occurs between these components. Therefore, when the cylinder bore 15 is expanded, the adhesion between the cylinder block 11 and the high temperature liner portion 26 is reduced.

In the cylinder liner 2 according to the present embodiment, the melting point of the high thermal conductive film 4 is less than or equal to the reference temperature TC. Thus, it is believed that, when producing the cylinder block 11, the high thermal conductive film 4 is melt and metallurgically bonded to the casting material. However, according to the results of tests performed by the present inventors, it was confirmed that the cylinder block 11 as described above was mechanically bonded to the high thermal conductive film 4. Further, metallurgically bonded portions were found. However, cylinder block 11 and the high thermal conductive film 4 were mainly bonded in a mechanical manner.

Through the tests, the inventors also found out the following. That is, even if the casting material and the high thermal conductive film 4 were not metallurgically bonded (or only partly bonded in a metallurgical manner), the adhesion and the bond strength of the cylinder block 11 and the high temperature liner portion 26 were increased as long as the high thermal conductive film 4 had a melting point less than or equal to the reference temperature TC. Although the mechanism has not been accurately elucidated, it is believed that the rate of solidification of the casting material is reduced due to the fact that the heat of the casting material is not smoothly removed by the high thermal conductive film 4.

[2] Bonding State of Low Temperature Liner Portion

FIG. 10 is a cross-sectional view of encircled part ZB of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the low thermal conductive film 5 in between.

Since the low thermal conductive film 5 is formed of alumina, which has a lower thermal conductivity than that of the cylinder block 11, the cylinder block 11 and the low thermal conductive film 5 are mechanically bonded to each other in a state of a low thermal conductivity.

In the engine 1, since the cylinder block 11 and the low temperature liner portion 27 are bonded to each other in this state, the following advantages are obtained.

(A) Since the low thermal conductive film 5 reduces the thermal conductivity between the cylinder block 11 and the low temperature liner portion 27, the cylinder wall temperature TW in the low temperature liner portion 27 is increased.

(B) Since the projections 3 ensures the bond strength between the cylinder block 11 and the low temperature liner portion 27, exfoliation of the cylinder block 11 and the low temperature liner portion 27 is suppressed.

Formation of Projections

Referring to Table 1, the formation of the projections 3 on the cylinder liner 2 will be described.

As parameters related to the projection 3, a first area ratio SA, a second area ratio SB, a standard cross-sectional area SD, a standard projection density NP, and a standard projection height HP are defined.

A measurement height H, a first reference plane PA, and a second reference plane PB, which are basic values for the parameters related to the projections 3, will now be described.

(a) The measurement height H represents the distance from the proximal end of the projection 3 along the axial direction of the projection 3. At the proximal end of the projection 3, the measurement height H is zero. At the top surface 32A of the projection 3, the measurement height H has the maximum value.

(b) The first reference plane PA represents a plane that lies along the radial direction of the projection 3 at the position of the measurement height of 0.4 mm.

(c) The second reference plane PB represents a plane that lies along the radial direction of the projection 3 at the position of the measurement height of 0.2 mm.

The parameters related to the projections 3 will now be described.

[A] The first area ratio SA represents the ratio of a radial direction cross-sectional area SR of the projection 3 in a unit area of the first reference plane PA. More specifically, the first area ratio SA represents the ratio of the area obtained by adding up the area of regions each surrounded by a contour line of a height of 0.4 mm to the area of the entire contour diagram of the liner outer circumferential surface 22.

[B] The second area ratio SB represents the ratio of a radial direction cross-sectional area SR of the projection 3 in a unit area of the second reference plane PB. More specifically, the second area ratio SB represents the ratio of the area obtained by adding up the area of regions each surrounded by a contour line of a height of 0.2 mm to the area of the entire contour diagram of the liner outer circumferential surface 22.

[C] The standard cross-sectional area SD represents a radial direction cross-sectional area SR, which is the area of one projection 3 in the first reference plane PA. That is, the standard cross-sectional area SD represents the area of each region surrounded by a contour line of a height of 0.4 mm in the contour diagram of the liner outer circumferential surface 22.

[D] The standard projection density NP represents the number of the projections 3 per unit area in the liner outer circumferential surface 22.

[E] The standard projection height HP represents the height of each projection 3.

TABLE 1

| | Type of Parameter | Selected Range |
|---|---|---|
| [A] | First area ratio SA | 10 to 50% |
| [B] | Second Area Ratio SB | 20 to 55% |

TABLE 1-continued

| | Type of Parameter | Selected Range |
|---|---|---|
| [C] | Standard Cross-Sectional Area SD | 0.2 to 3.0 $mm^2$ |
| [D] | Standard projection density NP | 5 to 60 number/$cm^2$ |
| [E] | Standard Projection Height HP | 0.5 to 1.0 mm |

In the present embodiment, the parameters [A] to [E] are set to be within the selected ranges in Table 1, so that the effect of increase of the liner bond strength by the projections 3 and the filling factor of the casting material between the projections 3 are increased. Since the filling factor of casting material is increased, gaps are unlikely to be created between the cylinder block 11 and the cylinder liners 2. The cylinder block 11 and the cylinder liners 2 are bonded while closing contacting each other.

In addition, the projections 3 are formed on the cylinder liner 2 to be independent from one another on the first reference plane PA in the present embodiment. In other words, a cross-section of each projection 3 by a plane containing the contour line representing a height of 0.4 mm from its proximal end is independent from cross-sections of the other projections 3 by the same plane. This further improves the adhesion.

Method for Producing Cylinder Liner

Referring to FIGS. 11 and 12 and Table 2, a method for producing the cylinder liner 2 will be described.

In the present embodiment, the cylinder liner 2 is produced by centrifugal casting. To make the above listed parameters related to the projections 3 fall in the selected ranges of Table 1, the following parameters [A] to [F] related to the centrifugal casting are set to be within selected range of Table 2.

[A] The composition ratio of a refractory material 61A in a suspension 61.

[B] The composition ratio of a binder 61B in the suspension 61.

[C] The composition ratio of water 61C in the suspension 61.

[D] The average particle size of the refractory material 61A.

[E] The composition ratio of added surfactant 62 to the suspension 61.

[F] The thickness of a layer of a mold wash 63 (mold wash layer 64).

TABLE 2

| | Type of parameter | Selected range |
|---|---|---|
| [A] | Composition ratio of refractory material | 8 to 30% by mass |
| [B] | Composition ratio of binder | 2 to 10% by mass |
| [C] | Composition ratio of water | 60 to 90% by mass |
| [D] | Average particle size of refractory material | 0.02 to 0.1 mm |
| [E] | Composition ratio of surfactant | more than 0.005% by mass and 0.1% by mass or less |
| [F] | Thickness of mold wash layer | 0.5 to 1.0 mm |

The production of the cylinder liner 2 is executed according to the procedure shown in FIGS. 11A to 11F.

Figure 11A:
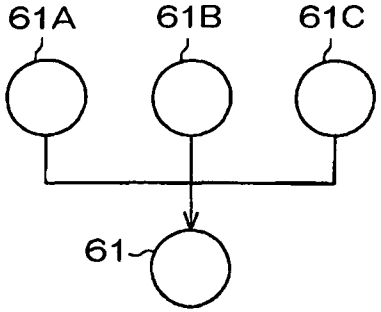
FIGS. 11A, 11B, 11C, 11D, 11E and 11F are process diagrams showing steps for producing a cylinder liner through the centrifugal casting.

[Step A] The refractory material 61A, the binder 61B, and the water 61C are compounded to prepare the suspension 61 as shown in FIG. 11A. In this step, the composition ratios of the refractory material 61A, the binder 61B, and the water 61C, and the average particle size of the refractory material 61A are set to fall within the selected ranges in Table 2.

Figure 11B:
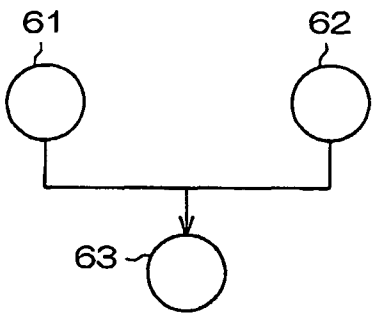

[Step B] A predetermined amount of the surfactant 62 is added to the suspension 61 to obtain the mold wash 63 as shown in FIG. 11B. In this step, the ratio of the added surfactant 62 to the suspension 61 is set to fall within the selected range shown in Table 2.

Figure 11C:
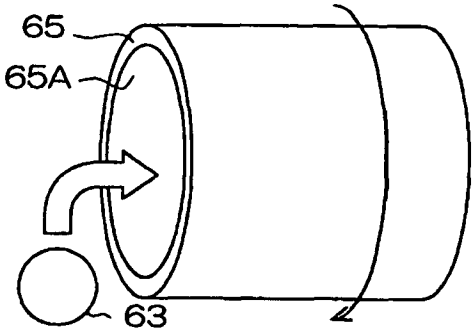

[Step C] After heating the inner circumferential surface of a rotating mold 65 to a predetermined temperature, the mold wash 63 is applied through spraying on an inner circumferential surface of the mold 65 (mold inner circumferential surface 65A), as shown in FIG. 11C. At this time, the mold wash 63 is applied such that a layer of the mold wash 63 (mold wash layer 64) of a substantially uniform thickness is formed on the entire mold inner circumferential surface 65A. In this step, the thickness of the mold wash layer 64 is set to fall within the selected range shown in Table 2.

Figure 12A:
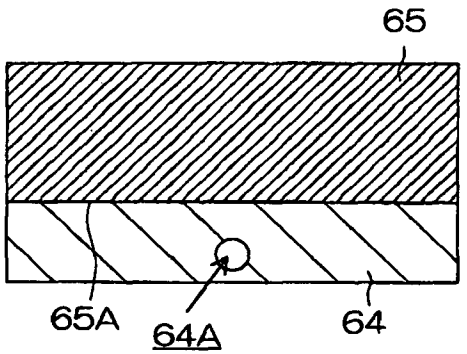
FIGS. 12A, 12B and 12C are process diagrams showing steps for forming a recess having a constricted shape in a mold wash layer in the production of the cylinder liner through the centrifugal casting.
Figure 12B:
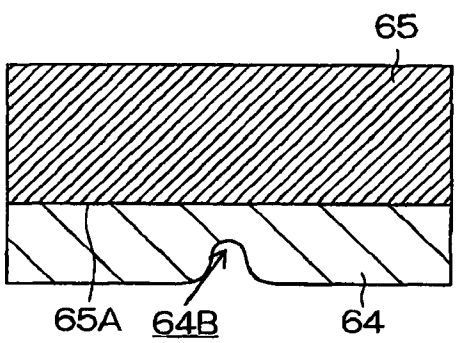
Figure 12C:
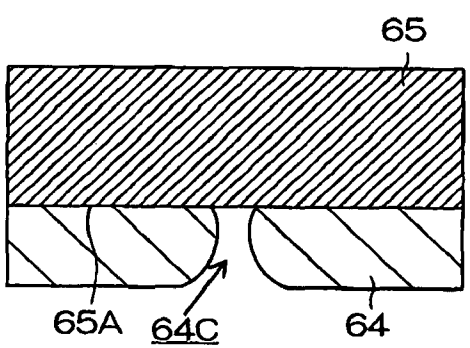

In the mold wash layer 64 of the mold 65, holes having a constricted shape are formed after [Step C]. Referring to FIGS. 12A to 12C, the formation of the holes having a constricted shape will be described.

[1] The mold wash layer 64 with a plurality of bubbles 64A is formed on the mold inner circumferential surface 65A of the mold 65, as shown in FIG. 12A.

[2] The surfactant 62 acts on the bubbles 64A to form recesses 64B in the inner circumferential surface of the mold wash layer 64, as shown in FIG. 12B.

[3] The bottom of the recess 64B reaches the mold inner circumferential surface 65A, so that a hole 64C having a constricted shape is formed in the mold wash layer 64, as shown in FIG. 12C.

Figure 11D:
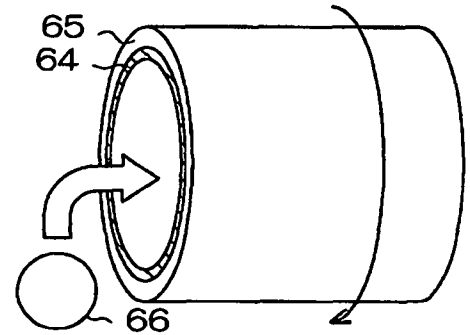

[Step D] After the mold wash layer 64 is dried, molten cast iron 66 is poured into the mold 65, which is being rotated, as shown in FIG. 11D. The molten cast iron 66 flows into the hole 64C having a constricted shape in the mold wash layer 64. Thus, the projections 3 having a constricted shape are formed on the cast cylinder liner 2.

Figure 11E:
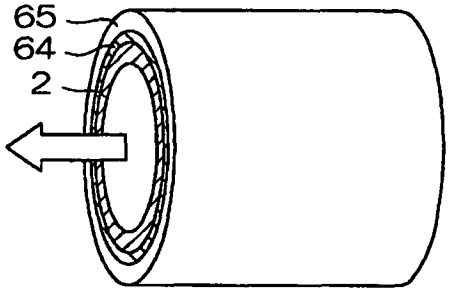

[Step E] After the molten cast iron 66 is hardened and the cylinder liner 2 is formed, the cylinder liner 2 is taken out of the mold 65 with the mold wash layer 64, as shown in FIG. 11E.

Figure 11F:
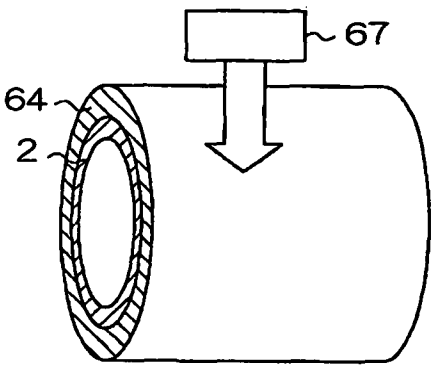

[Step F] Using a blasting device 67, the mold wash layer 64 (mold wash 63) is removed from the outer circumferential surface of the cylinder liner 2, as shown in FIG. 11F.

Method for Measuring Parameters related to Projections

Figure 13B:
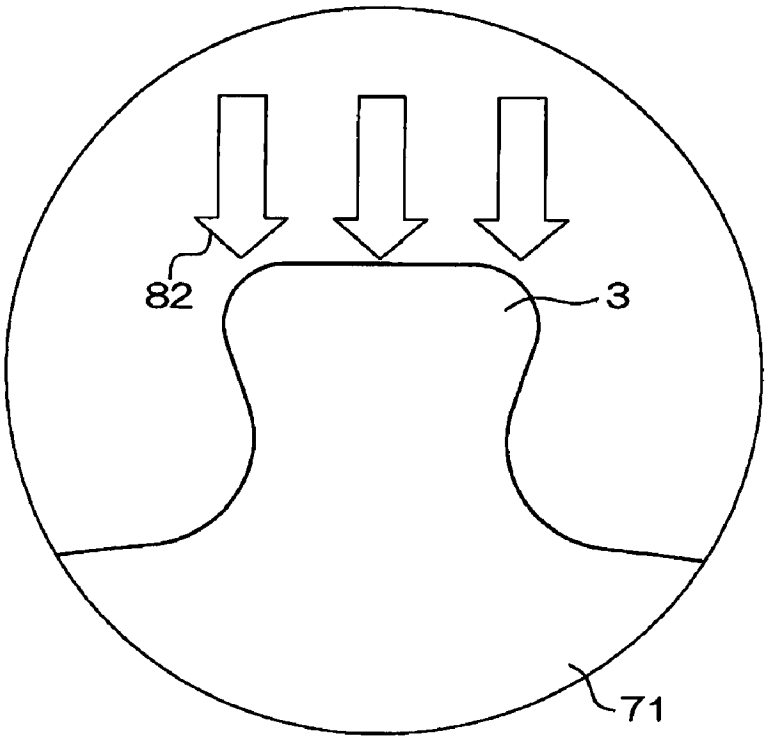
FIGS. 13A and 13B are diagrams showing one example of the procedure for measuring parameters of the cylinder liner according to the first embodiment, using a three-dimensional laser.
Figure 13A:
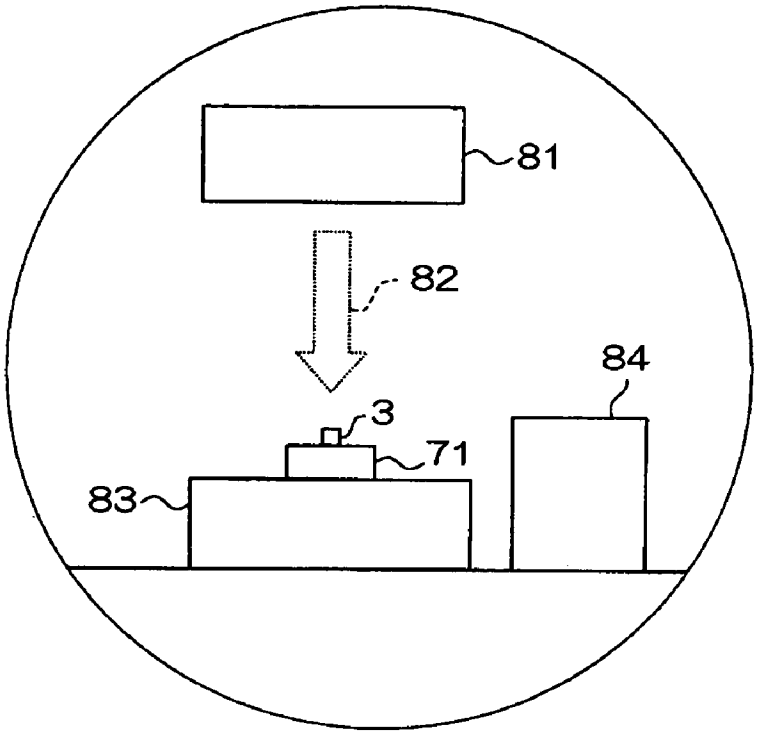

Referring to FIGS. 13A and 13B, a method for measuring the parameters related to projections 3 using a three-dimensional laser will be described. The standard projection height HP is measured by another method.

Each of the parameters related to the projections 3 can be measured in the following manner.

[1] A test piece 71 for measuring parameters of projections 3 is made from the cylinder liner 2.

[2] In a noncontact three-dimensional laser measuring device 81, the test piece 71 is set on a test bench 83 such that the axial direction of the projections 3 is substantially parallel to the irradiation direction of laser light 82 (FIG. 13A).

[3] The laser light 82 is irradiated from the three-dimensional laser measuring device 81 to the test piece 71 (FIG. 13B).

[4] The measurement results of the three-dimensional laser measuring device 81 are imported into an image processing device 84.

[5] Through the image processing performed by the image processing device 84, a contour diagram 85 (FIG. 14) of the liner outer circumferential surface 22 is displayed. The parameters related to the projections 3 are computed based on the contour diagram 85.

Contour Lines of Liner Outer Circumferential Surface

Figure 14:
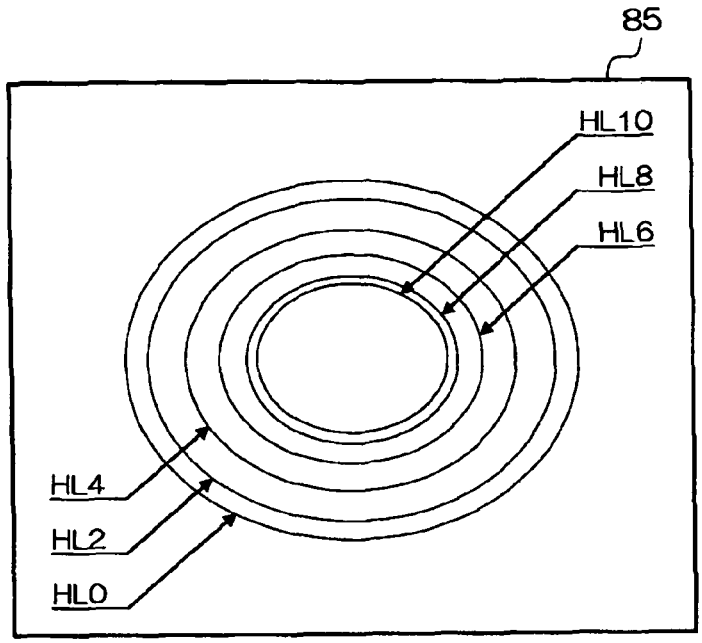
FIG. 14 is a diagram partly showing one example of contour lines of the cylinder liner according to the first embodiment, obtained through measurement using a three-dimensional laser.
Figure 15:
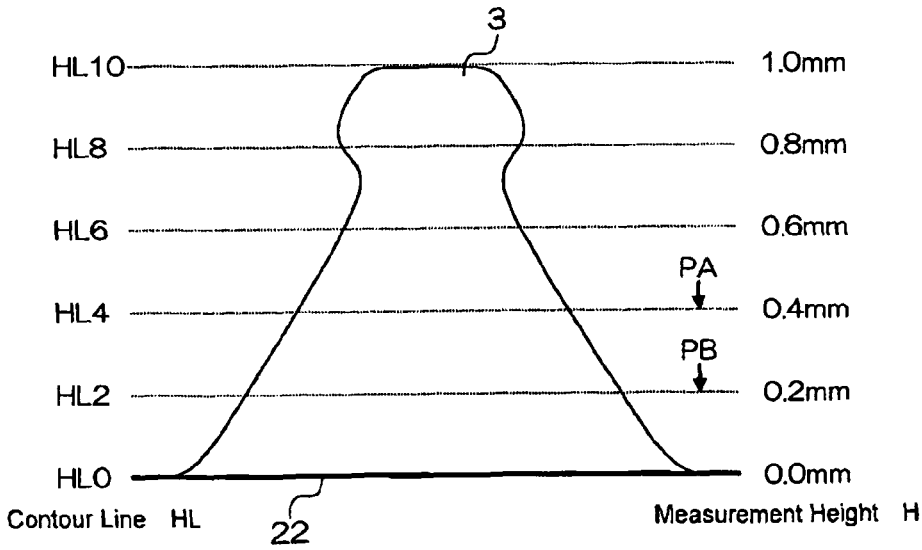
FIG. 15 is a diagram showing the relationship between the measured height and the contour lines of the cylinder liner of the first embodiment.

Referring to FIGS. 14 and 15, the contour diagram 85 of the liner outer circumferential surface 22 will be explained. FIG. 14 is a part of one example of the contour diagram 85. FIG. 15 shows the relationship between the measurement height H and contour lines HL. The contour diagram 85 of FIG. 14 is drawn based in accordance with the liner outer circumferential surface 22 having a projection 3 that is different from the projection 3 of FIG. 15.

In the contour diagram 85, the contour lines HL are shown at every predetermined value of the measurement height H.

For example, in the case where the contour lines HL are shown at a 0.2 mm interval from the measurement height of 0 mm to the measurement height of 1.0 mm in the contour diagram 85, contour lines HL0 of the measurement height of 0 mm, contour lines HL2 of the measurement height of 0.2 mm, contour lines HL4 of the measurement height of 0.4 mm, contour lines HL6 of the measurement height of 0.6 mm, contour lines HL8 of the measurement height of 0.8 mm, and contour lines HL10 of the measurement height of 1.0 mm are shown.

The contour lines HL4 are contained in the first reference plane PA. The contour lines HL2 are contained in the second reference plane PB. Although FIG. 14 shows a diagram in which the contour lines HL are shown at a 0.2 mm interval, the distance between the contour lines HL may be changed as necessary.

Figure 16:
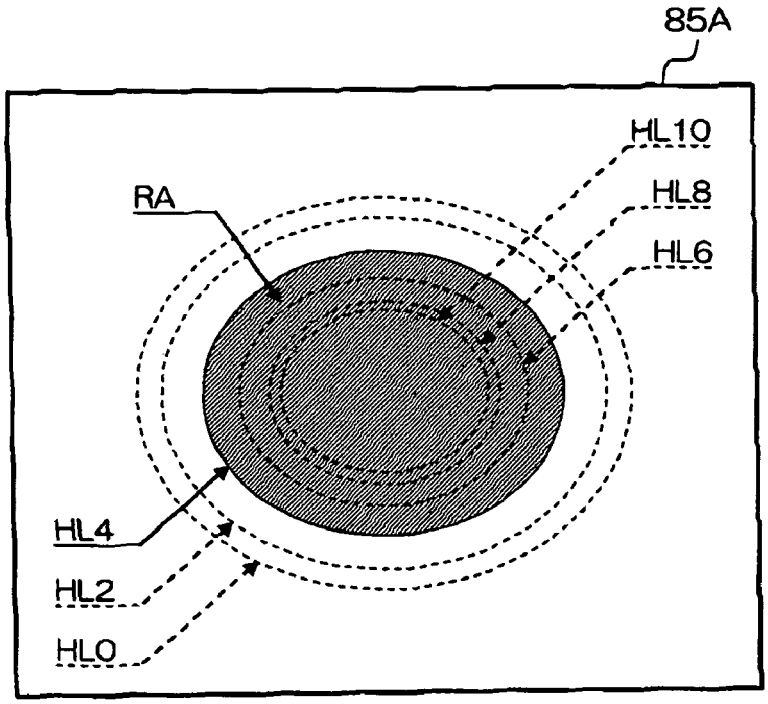
FIGS. 16 and 17 are diagrams each partly showing another example of contour lines of the cylinder liner according to the first embodiment, obtained through measurement using a three-dimensional laser.
Figure 17:
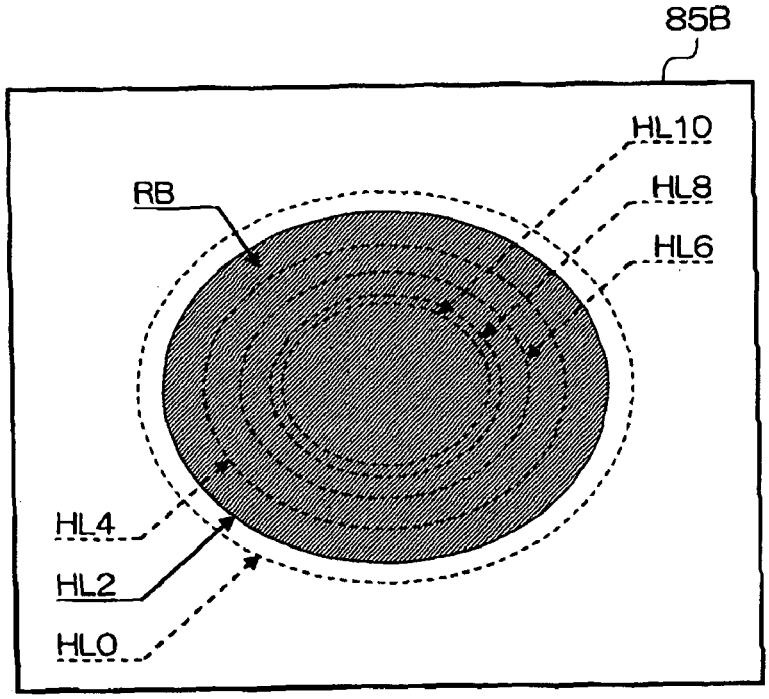

Referring to FIGS. 16 and 17, first regions RA and second regions RB in the contour diagram 85 will be described. FIG. 16 is a part of a first contour diagram 85A, in which the contour lines HL4 of the measurement height of 0.4 mm in the contour diagram 85 are shown in solid lines and the other contour lines HL in the contour diagram 85 are shown in dotted lines. FIG. 17 is a part of a second contour diagram 85B, in which the contour lines HL2 of the measurement height of 0.2 mm in the contour diagram 85 are shown in solid lines and the other contour lines HL in the contour diagram 85 are shown in dotted lines.

In the present embodiment, regions each surrounded by the contour line HL4 in the contour diagram 85 are defined as the first regions RA. That is, the shaded areas in the first contour diagram 85A correspond to the first regions RA. Regions each surrounded by the contour line HL2 in the contour diagram 85 are defined as the second regions RB. That is, the shaded areas in the second contour diagram 85B correspond to the second regions RB.

Method for Computing Parameters related to Projections

As for the cylinder liner 2 according to the present embodiment, the parameters related to the projections 3 are computed in the following manner based on the contour diagram 85.

[A] First area ratio SA

The first area ratio SA is computed as the ratio of the total area of the first regions RA to the area of the entire contour diagram 85. That is, the first area ratio SA is computed by using the following formula.

$$SA=SRA/ST\times 100[\%]$$

In the above formula, the symbol ST represents the area of the entire contour diagram 85. The symbol SRA represents the total area of the first regions RA in the contour diagram 85. For example, when FIG. 16, which shows a part of the first contour diagram 85A, is used as a model, the area of the rectangular zone surrounded by the frame corresponds to the area ST, and the area of the shaded zone corresponds to the area SRA. When computing the first area ratio SA, the contour diagram 85 is assumed to include only the liner outer circumferential surface 22.

[B] Second Area Ratio SB

The second area ratio SB is computed as the ratio of the total area of the second regions RB to the area of the entire contour diagram 85. That is, the second area ratio SB is computed by using the following formula.

$$SB=SRB/ST\times 100[\%]$$

In the above formula, the symbol ST represents the area of the entire contour diagram 85. The symbol SRB represents the total area of the second regions RB in the contour diagram 85. For example, when FIG. 17, which shows a part of the second contour diagram 85B, is used as a model, the area of the rectangular zone surrounded by the frame corresponds to the area ST, and the area of the shaded zone corresponds to the area SRB. When computing the second area ratio SB, the contour diagram 85 is assumed to include only the liner outer circumferential surface 22.

[C] Standard Cross-sectional Area SD

The standard cross-sectional area SD can be computed as the area of each first region RA in the contour diagram 85. For example, when FIG. 16, which shows a part of the first contour diagram 85A, is used as a model, the area of the shaded area corresponds to standard cross-sectional area SD.

[D] Standard Projection Density NP

The standard projection density NP can be computed as the number of projections 3 per unit area in the contour diagram 85 (in this embodiment, 1 $cm^2$)

[E] Standard Projection Height HP

The standard projection height HP represents the height of each projection 3. The height of each projection 3 may be a mean value of the heights of the projection 3 at several locations. The height of the projections 3 can be measured by a measuring device such as a dial depth gauge.

Whether the projections 3 are independently provided on the first reference plane PA can be checked based on the first regions RA in the contour diagram 85. That is, when each first region RA does not interfere with other first regions RA, it is confirmed that the projections 3 are independently provided on the first reference plane PA. In other words, it is confirmed that a cross-section of each projection 3 by a plane containing the contour line representing a height of 0.4 mm from its proximal end is independent from cross-sections of the other projections 3 by the same plane.

Hereinafter, the present invention will be described based on comparison between examples and comparison examples.

In each of the examples and the comparison examples, cylinder liners were produced by centrifugal casting. When producing cylinder liners, a material of casting iron, which corresponds to FC230 was used, and the thickness of the finished cylinder liner was set to 2.3 mm.

Table 3 shows the characteristics of cylinder liners of the examples. Table 4 shows the characteristics of cylinder liners of the comparison examples.

TABLE 3

| | Characteristics of Cylinder Liner |
|---|---|
| Ex. 1 | (1) Form a high thermal conductive film by a sprayed layer of Al—Si alloy<br>(2) Set the first area ratio to a lower limit value (10%) |
| Ex. 2 | (1) Form a high thermal conductive film by a sprayed layer of Al—Si alloy<br>(2) Set the second area ratio to an upper limit value (55%) |
| Ex. 3 | (1) Form a high thermal conductive film by a sprayed layer of Al—Si alloy<br>(2) Set the film thickness to 0.005 mm |
| Ex. 4 | (1) Form a high thermal conductive film by a sprayed layer of Al—Si alloy<br>(2) Set the film thickness to an upper limit value (0.5 mm) |

TABLE 4

| | Characteristics of cylinder liner |
|---|---|
| C. Ex. 1 | (1) No high thermal conductive film is formed.<br>(2) Set the first area ratio to a lower limit value (10%). |
| C. Ex. 2 | (1) No high thermal conductive film is formed.<br>(2) Set the second area ratio to an upper limit value (55%). |
| C. Ex. 3 | (1) Form a high thermal conductive film by a sprayed layer of Al—Si alloy<br>(2) No projection with constriction is formed. |
| C. Ex. 4 | (1) Form a high thermal conductive film by a sprayed layer of Al—Si alloy.<br>(2) Set the first area ratio to a value lower than the lower limit value (10%). |
| C. Ex. 5 | (1) Form a high thermal conductive film by a sprayed layer of Al—Si alloy.<br>(2) Set the second area ratio to a value higher than the upper limit value (55%). |
| C. Ex. 6 | (1) Form a high thermal conductive film by a sprayed layer of Al—Si alloy.<br>(2) Set the film thickness to a value greater than the upper limit value (0.5 mm). |

Producing conditions of cylinder liners specific to each of the examples and comparison examples are shown below. Other than the following specific conditions, the producing conditions are common to all the examples and the comparison examples.

In the example 1 and the comparison example 1, parameters related to the centrifugal casting ([A] to [F] in Table 2) were set in the selected ranges shown in Table 2 so that the first area ratio SA becomes the lower limit value (10%).

In the example 2 and the comparison example 2, parameters related to the centrifugal casting ([A] to [F] in Table 2) were set in the selected ranges shown in Table 2 so that the second area ratio SB becomes the upper limit value (55%).

In the examples 3 and 4, and the comparison example 6, parameters related to the centrifugal casting ([A] to [F] in Table 2) were set to the same values in the selected ranges shown in Table 2.

In the comparison example 3, casting surface was removed after casting to obtain a smooth outer circumferential surface.

In the comparison example 4, at least one of the parameters related to the centrifugal casting ([A] to [F] in Table 2) was set outside of the selected range in Table 2 so that the first area ratio SA becomes less than the lower limit value (10%).

In the comparison example 5, at least one of the parameters related to the centrifugal casting ([A] to [F] in Table 2) was set outside of the selected range in Table 2 so that the second area ratio SB becomes more than the upper limit value (55%).

The conditions for forming films are shown below.

The film thickness TP was set the same value in the examples 1 and 2, and the comparison examples 3, 4 and 5.

In the example 4, the film thickness TP was set to the upper limit value (0.5 mm).

In the comparison examples 1 and 2, no film was formed.

In the comparison example 6, the film thickness TP was set to a value greater than the upper limit value (0.5 mm).

Measurement and Computation of Parameters Related to Projections

The measurement and computation of the parameters related to the projections in each of the examples and the comparison examples will now be explained.

In each of the examples and comparison examples, parameters related to the projections were measured and computed according to "Method for Measuring Parameters related to Projections" and "Method for Computing Parameters related to Projections."

Measurement of Film Thickness

The measuring method of the film thickness TP in each of the examples and the comparison examples will now be explained.

In each of the examples and the comparison examples, the film thickness TP was measured with a microscope. Specifically, the film thickness TP was measured according to the following processes [1] and [2].

[1] A test piece for measuring the film thickness is made from the cylinder liner 2.

[2] The film thickness TP is measured at several positions in the test piece using a microscope, and the mean value of the measured values is computed as a measured value of the film thickness TP.

Evaluation of Bond Strength

Figure 18C:
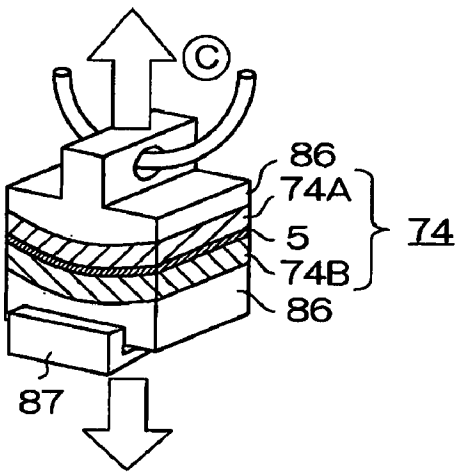
FIGS. 18A, 18B and 18C are diagrams showing one example of a procedure of a tensile test for evaluating the bond strength of the cylinder liner according to the first embodiment in a cylinder block.
Figure 18B:
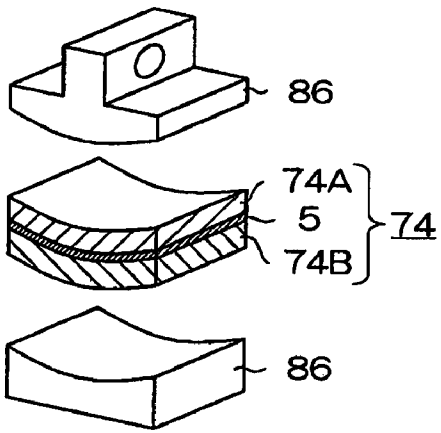
Figure 18A:
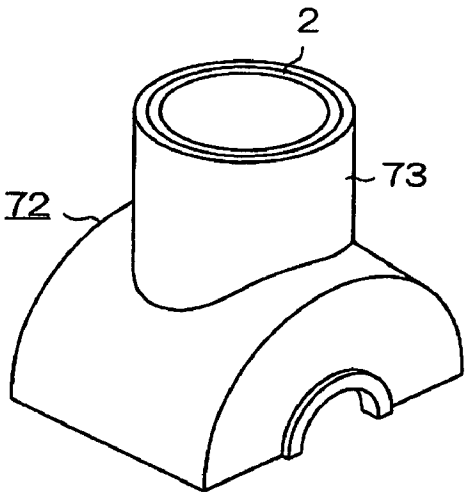

Referring to FIGS. 18A to 18C, a method for evaluating the liner bond strength in each of the examples and the comparison examples will be explained.

In each of the examples and the comparison examples, tensile test was adopted as a method for evaluating the liner bond strength. Specifically, the evaluation of the liner bond strength was performed according to the following processes [1] and [5].

[1] Single cylinder type cylinder blocks 72, each having a cylinder liner 2, were produced through die casting (FIG. 18A).

[2] Test pieces 74 for strength evaluation were made from the single cylinder type cylinder blocks 72. The strength evaluation test pieces 74 were each formed of a liner piece 74A, which is a part of the cylinder liner 2, and an aluminum piece 74B, which is an aluminum part of the cylinder 73. The high thermal conductive film 4 is formed between each liner piece 74A and the corresponding aluminum piece 74B.

[3] Arms 86 of a tensile test device were bonded to the strength evaluation test piece 74, which includes the liner piece 74A and the aluminum piece 74B (FIG. 18B).

[4] After one of the arms 86 was held by a clamp 87, a tensile load was applied to the strength evaluation test piece 74 by the other arm 86 such that liner piece 74A and the aluminum piece 74B were exfoliated in a direction of arrow C, which is a radial direction of the cylinder (FIG. 18C).

[5] Through the tensile test, the magnitude of the load per unit area at which the liner piece 74A and the aluminum piece 74B were exfoliated was obtained as the liner bond strength.

TABLE 5

| | | |
|---|---|---|
| [A] | Aluminum Material | ADC12 |
| [B] | Casting Pressure | 55 MPa |
| [C] | Casting Speed | 1.7 m/s |
| [D] | Casting Temperature | 670° C. |
| [E] | Cylinder Thickness without the cylinder liner | 4.0 mm |

In each of the examples and the comparison examples, the single cylinder type cylinder block 72 for evaluation was produced under the conditions shown in Table 5.

Evaluation of Thermal Conductivity

Figure 19C:
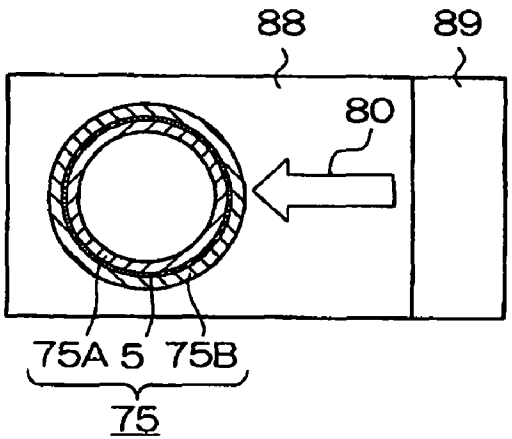
FIGS. 19A, 19B and 19C are diagrams showing one example of a procedure of a laser flash method for evaluating the thermal conductivity of the cylinder block having the cylinder liner according to the first embodiment.
Figure 19B:
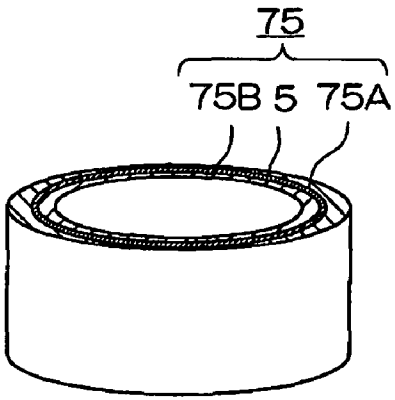
Figure 19A:
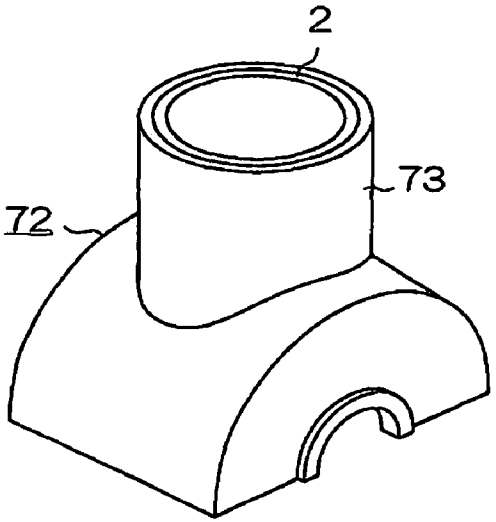

Referring to FIGS. 19A to 19C, a method for evaluating the cylinder thermal conductivity (thermal conductivity between the cylinder block 11 and the high temperature liner portion 26) in each of the examples and the comparison examples will be explained.

In each of the examples and the comparison examples, the laser flash method was adopted as the method for evaluating the cylinder thermal conductivity. Specifically, the evaluation of the thermal conductivity was performed according to the following processes [1] and [4].

[1] Single cylinder type cylinder blocks 72, each having a cylinder liner 2, were produced through die casting (FIG. 19A).

[2] Annular test pieces 75 for thermal conductivity evaluation were made from the single cylinder type cylinder blocks 72 (FIG. 19B). The thermal conductivity evaluation test pieces 75 were each formed of a liner piece 75A, which is a part of the cylinder liner 2, and an aluminum piece 75B, which is an aluminum part of the cylinder 73. The high thermal conductive film 4 is formed between the each liner piece 75A and the corresponding aluminum piece 75B.

[3] After setting the thermal conductivity evaluation test piece 75 in a laser flash device 88, laser light 80 is irradiated from a laser oscillator 89 to the outer circumference of the test piece 75 (FIG. 19C).

[4] Based on the test results measured by the laser flash device 88, the thermal conductivity of the thermal conductivity evaluation test piece 75 was computed.

TABLE 6

| | | |
|---|---|---|
| [A] | Liner Piece Thickness | 1.35 mm |
| [B] | Aluminum Piece Thickness | 1.65 mm |
| [C] | Outer Diameter of Test Piece | 10 mm |

In each of the examples and the comparison examples, the single cylinder type cylinder block 72 for evaluation was produced under the conditions shown in Table 5. The thermal conductivity evaluation test piece 75 was produced under the conditions shown in Table 6. Specifically, a part of the cylinder 73 was cut out from the single cylinder type cylinder block 72. The outer and inner circumferential surfaces of the cut out part were machined such that the thicknesses of the liner piece 75A and the aluminum piece 75B were the values shown in Table 6.

Measurement Results

Table 7 shows the measurement results of the parameters in the examples and the comparison examples. The values in the table are each a representative value of several measurement results.

TABLE 7

| | First Area Ratio [%] | Second Area Ratio [%] | Standard Projection Density [Number/cm$^2$] | Standard Projection Height [mm] | Film Material | Film Thickness [mm] | Bond Strength [MPa] | Thermal Conductivity [W/mK] |
|---|---|---|---|---|---|---|---|---|
| Ex. 1 | 10 | 20 | 20 | 0.6 | Al—Si alloy | 0.08 | 35 | 50 |
| Ex. 2 | 50 | 55 | 60 | 1.0 | Al—Si alloy | 0.08 | 55 | 50 |
| Ex. 3 | 20 | 35 | 35 | 0.7 | Al—Si alloy | 0.005 | 50 | 60 |
| Ex. 4 | 20 | 35 | 35 | 0.7 | Al—Si alloy | 0.5 | 45 | 55 |
| C. Ex. 1 | 10 | 20 | 20 | 0.6 | No film | — | 17 | 25 |
| C. Ex. 2 | 50 | 55 | 60 | 1.0 | No film | — | 52 | 25 |
| C. Ex. 3 | 0 | 0 | 0 | 0 | Al—Si alloy | 0.08 | 22 | 60 |
| C. Ex. 4 | 2 | 10 | 3 | 0.3 | Al—Si alloy | 0.08 | 15 | 40 |
| C. Ex. 5 | 25 | 72 | 30 | 0.8 | Al—Si alloy | 0.08 | 40 | 35 |
| C. Ex. 6 | 20 | 35 | 35 | 0.7 | Al—Si alloy | 0.6 | 10 | 30 |

The advantages recognized based on the measurement results will now be explained.

By contrasting the examples 1 to 4 with the comparison example 3, the following facts were discovered. That is, formation of the projections 3 on the cylinder liner 2 increases the liner bond strength.

By contrasting the example 1 with the comparison example 1, the following facts were discovered. That is, formation of the high thermal conductive film 4 on the high temperature liner portion 26 increases the thermal conductivity between the cylinder block 11 and the high temperature liner portion 26. Further, the liner bond strength is increased.

By contrasting the example 2 with the comparison example 2, the following facts were discovered. That is, formation of the high thermal conductive film 4 on the high temperature liner portion 26 increases the thermal conductivity between the cylinder block 11 and the high temperature liner portion 26. Further, the liner bond strength is increased.

By contrasting the example 4 with the comparison example 6, the following facts were discovered. That is, formation of the high thermal conductive film 4 having thickness TP less than or equal to the upper value (0.5 mm) increases the thermal conductivity between the cylinder block 11 and the high temperature liner portion 26. Further, the liner bond strength is increased.

By contrasting the example 1 with the comparison example 4, the following facts were discovered. That is, forming the projections 3 such that the first area ratio SA is more than or equal to the lower limit value (10%) increases the liner bond strength. Also, the thermal conductivity between the cylinder block 11 and the high temperature liner portion 26 is increased.

By contrasting the example 2 with the comparison example 5, the following facts were discovered. That is, forming the projections 3 such that the second area ratio SB is less than or equal to the upper limit value (55%) increases the liner bond strength. Also, the thermal conductivity between the cylinder block 11 and the high temperature liner portion 26 is increased.

By contrasting the example 3 with the example 4, the following facts were discovered. That is, forming the high thermal conductive film 4 while reducing the film thickness TP increases the liner bond strength. Also, the thermal conductivity between the cylinder block 11 and the high temperature liner portion 26 is increased.

Advantages of First Embodiment

The cylinder liner 2 and the engine 1 according to the present embodiment provide the following advantages.

(1) In the cylinder liner 2 of the present embodiment, the high thermal conductive film 4 is formed on the liner outer circumferential surface 22 of the high temperature liner portion 26, while the low thermal conductive film 5 is formed on the liner outer circumferential surface 22 of the low temperature liner portion 27. Accordingly, the cylinder wall temperature difference ΔTW, which is the difference between the maximum cylinder wall temperature TWH and the minimum cylinder wall temperature TWL in the engine 1, is reduced. Thus, variation of deformation of each cylinder bore 15 along the axial direction of the cylinder 13 is reduced. Accordingly, deformation amount of deformation of each cylinder bore 15 is equalized. This reduces the friction of the piston and thus improves the fuel consumption rate.

(2) In the cylinder liner 2 of the present embodiment, the high thermal conductive film 4 is formed of a sprayed layer of Al—Si alloy. This reduces the difference between the degree of expansion of the cylinder block 11 and the degree of expansion of the high thermal conductive film 4. Thus, when the cylinder bore 15 expands, the adhesion between the cylinder block 11 and the cylinder liner 2 is ensured.

(3) Since an Al—Si alloy that has a high wettability with the casting material of the cylinder block 11 is used, the adhesion and the bond strength between the cylinder block 11 and the high thermal conductive film 4 are further increased.

(4) In the cylinder liner 2 of the present embodiment, the high thermal conductive film 4 is formed such that its thickness TP is less than or equal to 0.5 mm. This prevents the bond strength between the cylinder block 11 and the high temperature liner portion 26 from being lowered. If the film thickness TP is greater than 0.5 mm, the anchor effect of the projections 3 will be reduced, resulting in a significant reduction in the bond strength between the cylinder block 11 and the high temperature liner portion 26.

(5) In the cylinder liner 2 of the present embodiment, the low thermal conductive film 5 is formed such that its thickness TP is less than or equal to 0.5 mm. This prevents the bond strength between the cylinder block 11 and the low temperature liner portion 27 from being lowered. If the film thickness TP is greater than 0.5 mm, the anchor effect of the projections 3 will be reduced, resulting in a significant reduction in the bond strength between the cylinder block 11 and the low temperature liner portion 27.

(6) In the cylinder liner 2 of the present embodiment, the projections 3 are formed on the liner outer circumferential surface 22. This permits the cylinder block 11 and cylinder liner 2 to be bonded to each other with the cylinder block 11 and the projections 3 engaged with each other. Sufficient bond strength between the cylinder block 11 and the cylinder liner 2 is ensured. Such increase in the bond strength prevents exfoliation between the cylinder block 11 and the high thermal conductive film 4 and between the cylinder block 11 and the low thermal conductive film 5. The effect of increase and reduction of thermal conductivity obtained by the films is reliably maintained. Also, the increase in the bond strength prevents the cylinder bore 15 from being deformed.

(7) In the cylinder liner 2 of the present embodiment, the projections 3 are formed such that the standard projection density NP is in the range from $5/cm^2$ to $60/cm^2$. This further increases the liner bond strength. Also, the filling factor of the casting material to spaces between the projections 3 is increased.

If the standard projection density NP is out of the selected range, the following problems will be caused. If the standard projection density NP is less than $5/cm^2$, the number of the projections 3 will be insufficient. This will reduce the liner bond strength. If the standard projection density NP is more than $60/cm^2$, narrow spaces between the projections 3 will reduce the filing factor of the casting material to spaces between the projections 3.

(8) In the cylinder liner 2 of the present embodiment, the projections 3 are formed such that the standard projection height HP is in the range from 0.5 mm to 1.0 mm. This increases the liner bond strength and the accuracy of the outer diameter of the cylinder liner 2.

If the standard projection height HP is out of the selected range, the following problems will be caused. If the standard projection height HP is less 0.5 mm, the height of the projections 3 will be insufficient. This will reduce the liner bond strength. If the standard projection height HP is more 1.0 mm, the projections 3 will be easily broken. This will also reduce the liner bond strength. Also, since the heights of the projection 3 are uneven, the accuracy of the outer diameter is reduced.

(9) In the cylinder liner 2 of the present embodiment, the projections 3 are formed such that the first area ratio SA is in the range from 10% to 50%. This ensures sufficient liner bond strength. Also, the filling factor of the casting material to spaces between the projections 3 is increased.

If the first area ratio SA is out of the selected range, the following problems will be caused. If the first area ratio SA is less than 10%, the liner bond strength will be significantly reduced compared to the case where the first area ratio SA is more than or equal to 10%. If the first area ratio SA is more than 50%, the second area ratio SB will surpass the upper limit value (55%). Thus, the filling factor of the casting material in the spaces between the projections 3 will be significantly reduced.

(10) In the cylinder liner 2 of the present embodiment, the projections 3 are formed such that the second area ratio SB is in the range from 20% to 55%. This increases the filling factor of the casting material to spaces between projections 3. Also, sufficient liner bond strength is ensured.

If the second area ratio SB is out of the selected range, the following problems will be caused. If the second area ratio SB is less than 20%, the first area ratio SA will fall below the lower limit value (10%). Thus, the liner bond strength will be significantly reduced. If the second area ratio SB is more than 55%, the filling factor of the casting material in the spaces between the projections 3 will be significantly reduced compared to the case where the second area ratio SB is less than or equal to 55%.

(11) In the cylinder liner 2 of the present embodiment, the projections 3 are formed such that the standard cross-sectional area SD is in the range from 0.2 $mm^2$ to 3.0 $mm^2$. Thus, during the producing process of the cylinder liners 2, the projections 3 are prevented from being damaged. Also, the filling factor of the casting material to spaces between the projections 3 is increased.

If the standard cross-sectional area SD is out of the selected range, the following problems will be caused. If the standard cross-sectional area SD is less than 0.2 $mm^2$, the strength of the projections 3 will be insufficient, and the projections 3 will be easily damaged during the production of the cylinder liner 2. If the standard cross-sectional area SD is more than 3.0 $mm^2$, narrow spaces between the projections 3 will reduce the filing factor of the casting material to spaces between the projections 3.

(12) In the cylinder liner 2 of the present embodiment, the projections 3 (the first areas RA) are formed to be independent from one another on the first reference plane PA. In other words, a cross-section of each projection 3 by a plane containing the contour line representing a height of 0.4 mm from its proximal end is independent from cross-sections of the other projections 3 by the same plane. This increases the filling factor of the casting material to spaces between projections 3. If the projections 3 (the first areas RA) are not independent from one another in the first reference plane PA, narrow spaces between the projections 3 will reduce the filing factor of the casting material to spaces between the projections 3.

(13) In the reference engine, since the consumption of the engine oil is promoted when the cylinder wall temperature TW of the high temperature liner portion 26 is excessively increased, the tension of the piston rings are required to be relatively great. That is, the fuel consumption rate is inevitably degraded by the increase in the tension of the piston rings.

In the cylinder liner 2 according to the present embodiment, sufficient adhesion between the cylinder block 11 and the high temperature liner portions 26 is established, that is, little gap is created about each high temperature liner portion 26. This ensures a high thermal conductivity between the cylinder block 11 and the high temperature liner portions 26. Accordingly, since the cylinder wall temperature TW in the high temperature liner portion 26 is lowered, the consumption of the engine oil is reduced. Since the consumption of the engine oil is suppressed in this manner, piston rings of a less tension compared to those in the reference engine can be used. This improves the fuel consumption rate.

(14) In the reference engine 1, the cylinder wall temperature TW in the low temperature liner portion 27 is relatively low. Thus, the viscosity of the engine oil at the liner inner circumferential surface 21 of the low temperature liner portion 27 is excessively high. That is, since the friction of the piston at the low temperature liner portion 27 of the cylinder 13 is great, deterioration of the fuel consumption rate due to such an increase in the friction is inevitable. Such deterioration of the fuel consumption rate due to the cylinder wall temperature TW is particularly noticeable in engines in which the thermal conductivity of the cylinder block is relatively great, such as an engine made of an aluminum alloy.

In the cylinder liner 2 of the present embodiment, since the thermal conductivity between the cylinder block 11 and the low temperature liner portion 27 is low, the cylinder wall temperature TW in the low temperature liner portion 27 is increased. This reduces the viscosity of the engine oil on the liner inner circumferential surface 21 of the low temperature liner portion 27, and thus reduces the friction. Accordingly, the fuel consumption rate is improved.

(15) In a conventional engine, reduction of the distance between the cylinder bores reduces the weight, and thus improves the fuel consumption rate. However, reduced distance between the cylinder bores causes the following problems.

[a] Sections between the cylinder bores are thinner than the surrounding sections (sections spaced from the sections between the cylinder bores). Thus, when producing the cylinder block through the insert casting, the rate of solidification is higher in the sections between the cylinder bores than in the surrounding sections. The solidification rate of the sections between the cylinder bores is increased as the thickness of such sections is reduced. Therefore, in the case where the distance between the cylinder bores is short, the solidification rate of the casting material is further increased. This increases the difference between the solidification rate of the casting material between the cylinder bores and that in the surrounding sections. Accordingly, a force that pulls the casting material located between the cylinder bores toward the surrounding sections is increased. This is highly likely to create cracks (hot tear) between the cylinder bores.

[b] In an engine in which the distance between the cylinder bores are short, heat is likely to be confined in a section between the cylinder bores. Thus, as the cylinder wall temperature increases, the consumption of the engine oil is promoted.

Accordingly, the following conditions need to be met when improving the fuel consumption rate through reduction of the distance between the cylinder bores.

To suppress the movement of the casting material from the sections between the cylinder bores to the surrounding sections due to the difference in the solidification rates, sufficient bond strength needs to be ensured between the cylinder liners and the casting material when producing the cylinder block.

To suppress the consumption of the engine oil, sufficient thermal conductivity needs to be ensured between the cylinder block and the cylinder liners.

According to the cylinder liner 2 of the present embodiment, when producing the cylinder block 11 through insert casting, the casting material of the cylinder block 11 and the projections 3 are engaged with each other so that sufficient bond strength of these components are ensured. This suppresses the movement of the casting material from the sections between the cylinder bores to the surrounding sections due to the difference in the solidification rates.

Since the high thermal conductive film 4 is formed together with the projections 3, the adhesion between the cylinder block 11 and the high temperature liner portion 26 is increased. This ensures sufficient thermal conductivity between the cylinder block 11 and the high temperature liner portion 26.

Further, since the projections 3 increase the bond strength between the cylinder block 11 and the cylinder liner 2, exfoliation of the cylinder block 11 and the cylinder liner 2 is suppressed. Therefore, even if the cylinder bore 15 is expanded, sufficient thermal conductivity between the cylinder block 11 and the high temperature liner portion 26 is ensured.

In this manner, the use of the cylinder liner 2 of the present embodiment ensures sufficient bond strength between the casting material of the cylinder block 11 and the cylinder liner 2, and sufficient thermal conductivity between the cylinder liner 2 and the cylinder block 11. This allows the distance between the cylinder bores 15 to be reduced. Accordingly, since the distance between the cylinder bores 15 in the engine 1 is shorter than that of conventional engines, the fuel consumption rate is improved.

According to the results of tests, the present inventors found out that in the cylinder block having the reference cylinder liners, relatively large gaps existed between the cylinder block and each cylinder liner. That is, if projections with constrictions are simply formed on the cylinder liner, sufficient adhesion between the cylinder block and the cylinder liner will not be ensured. This will inevitably lower the thermal conductivity due to gaps.

Modifications of First Embodiment

The above illustrated first embodiment may be modified as shown below.

Although an Al—Si alloy is used as the material of the high thermal conductive film 4, other aluminum alloys (an Al—Si—Cu alloy and an Al—Cu alloy) may be used. Other than aluminum alloy, the high thermal conductive film 4 may be formed of a sprayed layer of copper or copper alloy. In these cases, similar advantages to those of the first embodiment are obtained.

In the first embodiment, a sprayed layer of an aluminum-based material (aluminum sprayed layer) may be formed on the low thermal conductive film 5. In this case, the low thermal conductive film 5 is bonded to the cylinder block 11 with the aluminum sprayed layer in between. This increases the bond strength between the cylinder block 11 and the low temperature liner portion 27.

Second Embodiment

A second embodiment of the present invention will now be described with reference to FIGS. 20 and 21.

The second embodiment is configured by changing the formation of the high thermal conductive film 4 in the cylinder liner 2 of the first embodiment in the following manner. The cylinder liner 2 according to the second embodiment is the same as that of the first embodiment except for the configuration described below.

Formation of Film

Figure 20:
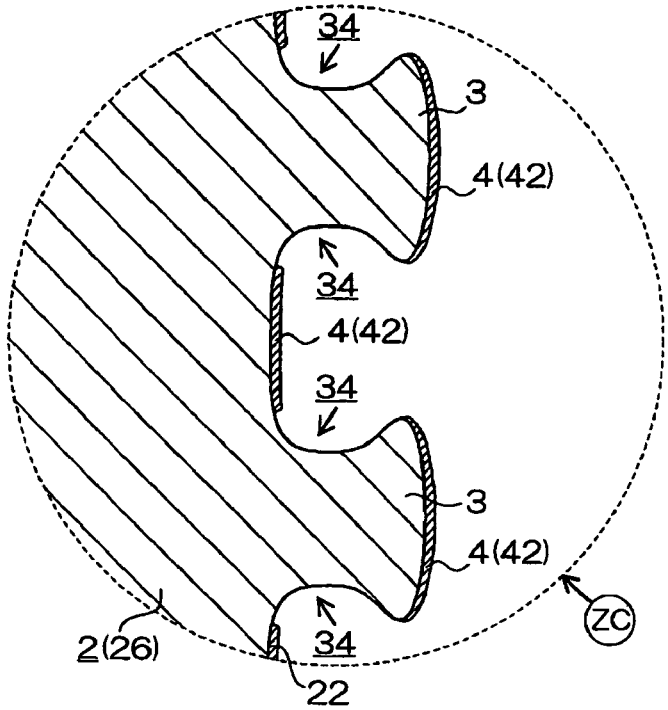
FIG. 20 is an enlarged cross-sectional view of a cylinder liner according to a second embodiment of the present invention, showing encircled part ZC of FIG. 6A.

FIG. 20 is an enlarged view showing encircled part ZC of FIG. 6A.

In the cylinder liner 2, a high thermal conductive film 4 is formed on a liner outer circumferential surface 22 of a high temperature liner portion 26. Unlike the high thermal conductive film 4 of the first embodiment, which is formed on the entire outer circumferential surface 22, the high thermal conductive film 4 of the second embodiment is formed on the top of each projection 3 and sections between adjacent projections 3.

The high thermal conductive film 4 is formed of an aluminum shot coating layer 42. The shot coating layer 42 is formed by shot coating.

Other materials that meet at least one of the following conditions (A) and (B) may be used as the material of the high thermal conductive film 4.

(A) A material the melting point of which is lower than or equal to the reference temperature TC, or a material containing such a material.

(B) A material that can be metallurgically bonded to the casting material of the cylinder block 11, or a material containing such a material.

Bonding State of Cylinder Block and High Temperature Liner Portion

Figure 21:
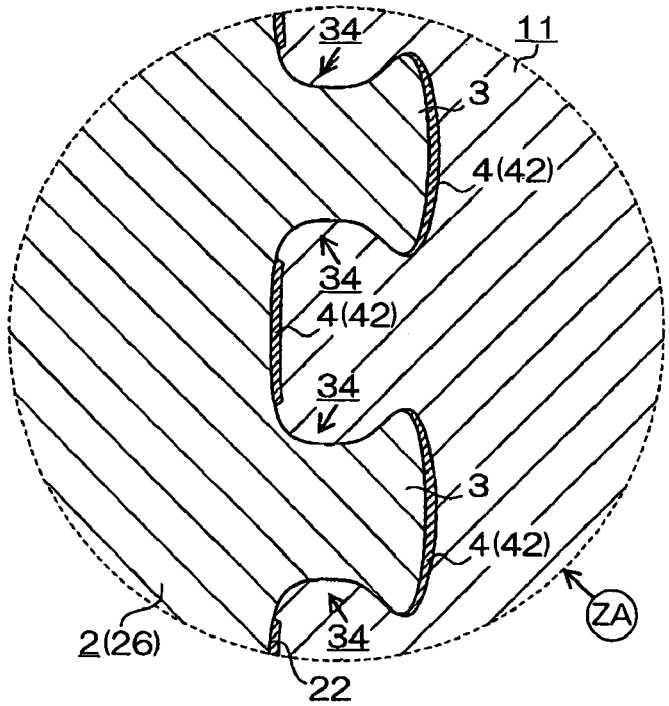
FIG. 21 is an enlarged cross-sectional view of the cylinder liner according to the second embodiment, showing encircled part ZA of FIG. 1.

FIG. 21 is a cross-sectional view of encircled part ZA of FIG. 1 and shows the bonding state between the cylinder block 11 and the high temperature liner portion 26.

In the engine 1, the cylinder block 11 is bonded to the high temperature liner portion 26 in a state where the cylinder block 11 is engaged with the projections 3. The cylinder block 11 and the high temperature liner portion 26 are bonded to each other with the high thermal conductive film 4 in between.

Since the high thermal conductive film 4 is formed by shot coating, the high temperature liner portion 26 and the high thermal conductive film 4 are mechanically bonded to each other with sufficient adhesion and bond strength. That is, the high temperature liner portion 26 and the high thermal conductive film 4 are bonded to each other in a state where mechanically bonded portions and metallurgically bonded portions are mingled. The adhesion of the high temperature liner portion 26 and the high thermal conductive film 4 is higher than the adhesion of the cylinder block and the reference cylinder liner in the reference engine.

The high thermal conductive film 4 is formed of aluminum that has a melting point lower than the reference temperature TC and a high wettability with the casting material of the cylinder block 11. Thus, the cylinder block 11 and the high thermal conductive film 4 are mechanically bonded to each other with sufficient adhesion and bond strength. The adhesion of the cylinder block 11 and the high thermal conductive film 4 is higher than the adhesion of the cylinder block and the reference cylinder liner in the reference engine.

In the engine 1, since the cylinder block 11 and the high temperature liner portion 26 are bonded to each other in this state, the advantages (A) to (C) in "[1] Bonding State of High Temperature Liner Portion" of the first embodiment are obtained. As for the mechanical joint between the cylinder block 11 and the high thermal conductive film 4, the same explanation as that of the first embodiment can be applied.

Advantages of Second Embodiment

In addition to the advantages (1) to (14) in the first embodiment, the cylinder liner 2 of the second embodiment provides the following advantage.

(15) In the present embodiment, the high thermal conductive film 4 is formed by shot coating. In the shot coating, the high thermal conductive film 4 is formed without melting the coating material. Therefore, the high thermal conductive film 4 contains no oxides. Therefore, the thermal conductivity of the high thermal conductive film 4 is prevented from degraded by oxidation.

Modifications of Second Embodiment

The above illustrated second embodiment may be modified as shown below.

In the second embodiment, aluminum is used as the material for the coating layer 42. However, for example, the following materials may be used.

[a] Zinc

[b] Tin

[c] An alloy that contains at least one of aluminum, zinc, and tin.

Third Embodiment

A third embodiment of the present invention will now be described with reference to FIGS. 22 and 23.

The third embodiment is configured by changing the formation of the high thermal conductive film 4 in the cylinder liner 2 of the first embodiment in the following manner. The cylinder liner 2 according to the third embodiment is the same as that of the first embodiment except for the configuration described below.

Formation of Film

Figure 22:
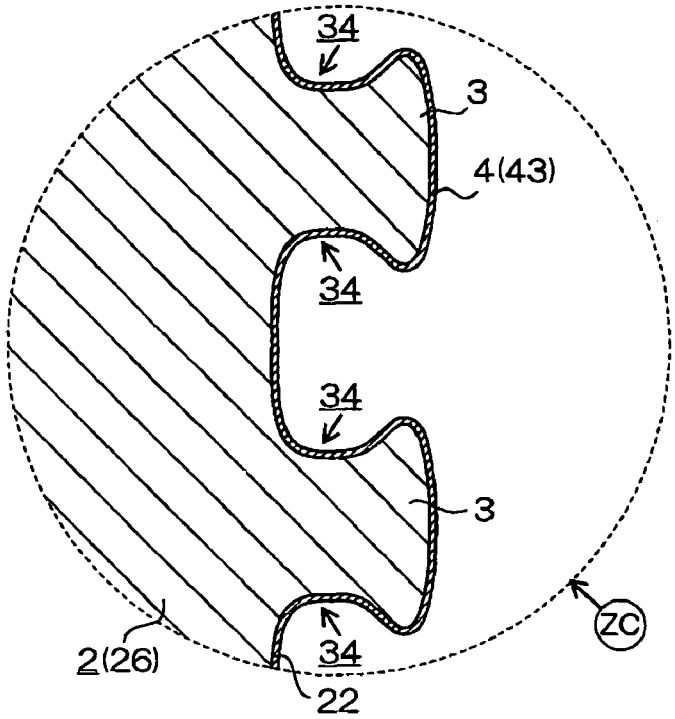
FIG. 22 is an enlarged cross-sectional view of a cylinder liner according to a third embodiment of the present invention, showing encircled part ZC of FIG. 6A.

FIG. 22 is an enlarged view showing encircled part ZC of FIG. 6A. In the cylinder liner 2, a high thermal conductive film 4 is formed on a liner outer circumferential surface 22 of a high temperature liner portion 26. The high thermal conductive film 4 is formed of a copper alloy plated layer 43. The plated layer 43 is formed by plating.

Other materials that meet at least one of the following conditions (A) and (B) may be used as the material of the high thermal conductive film 4.

(A) A material the melting point of which is lower than or equal to the reference molten metal temperature TC, or a material containing such a material.

(B) A material that can be metallurgically bonded to the casting material of the cylinder block 11, or a material containing such a material.

Bonding State of Cylinder Block and High Temperature Liner Portion

Figure 23:
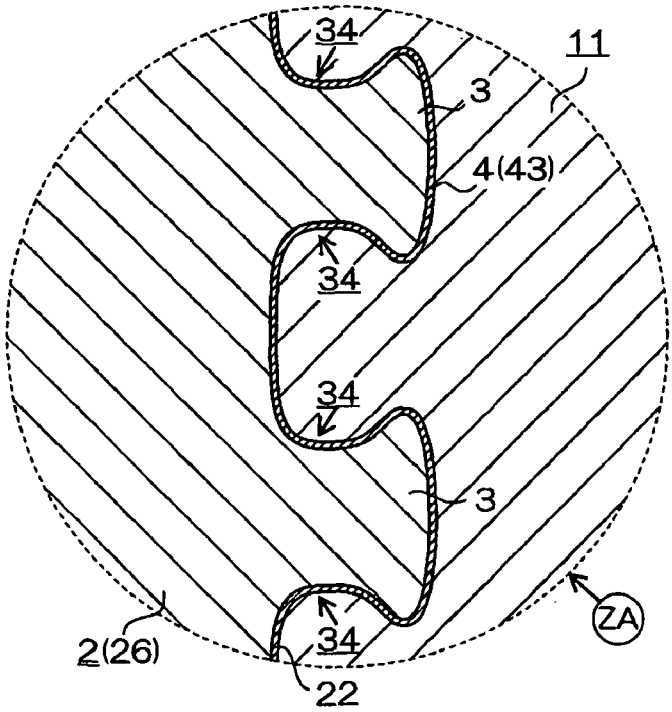
FIG. 23 is an enlarged cross-sectional view of the cylinder liner according to the third embodiment, showing encircled part ZA of FIG. 1.

FIG. 23 is a cross-sectional view of encircled part ZA of FIG. 1 and shows the bonding state between the cylinder block 11 and the high temperature liner portion 26.

In the engine 1, the cylinder block 11 is bonded to the high temperature liner portion 26 in a state where part of the cylinder block 11 is located in each of the constriction spaces 34. The cylinder block 11 and the high temperature liner portion 26 are bonded to each other with the high thermal conductive film 4 in between.

Since the high thermal conductive film 4 is formed by plating, the high temperature liner portion 26 and the high thermal conductive film 4 are mechanically bonded to each other with sufficient adhesion and bond strength. The adhesion of the high temperature liner portion 26 and the high thermal conductive film 4 is higher than the adhesion of the cylinder block and the reference cylinder liner in the reference engine.

The high thermal conductive film 4 is formed of a copper alloy that has a melting point higher than the reference temperature TC. However, the cylinder block 11 and the high thermal conductive film 4 are metallurgically bonded to each other with sufficient adhesion and bond strength. The adhesion of the cylinder block 11 and the high thermal conductive film 4 is higher than the adhesion of the cylinder block and the reference cylinder liner in the reference engine.

In the engine 1, since the cylinder block 11 and the high temperature liner portion 26 are bonded to each other in this state, an advantage (D) shown below is obtained in addition to the advantages (A) to (C) in "[1] Bonding State of High Temperature Liner Portion" of the first embodiment.

(D) Since the high thermal conductive film 4 is formed of a copper alloy having a greater thermal conductivity than that of the cylinder block 11, the thermal conductivity between the cylinder block 11 and the high temperature liner portion 26 is further increased.

To metallurgically bonding the cylinder block 11 and the high thermal conductive film 4 to each other, it is believed that the high thermal conductive film 4 basically needs to be formed with a metal having a melting point equal to or less than the reference temperature TC. However, according to the results of the tests performed by the present inventors, even if the high thermal conductive film 4 is formed of a metal having a melting point higher than the reference temperature TC, the cylinder block and the high thermal conductive film 4 are metallurgically bonded to each other in some cases.

Advantages of Third Embodiment

In addition to the advantages similar to the advantages (1) and (4) to (14) in the first embodiment, the cylinder liner 2 of the third embodiment provides the following advantages.

(16) In the present embodiment, the high thermal conductive film 4 is formed of a copper alloy. Accordingly, the cylinder block 11 and the high thermal conductive film 4 are metallurgically bonded to each other. The adhesion and the bond strength between the cylinder block 11 and the high temperature liner portion 26 are further increased.

(17) Since the copper alloy has a high thermal conductivity, the thermal conductivity between the cylinder block 11 and the high temperature liner portion 26 is significantly increased.

Modifications of Third Embodiment

The above illustrated third embodiment may be modified as shown below.

The plated layer 43 may be formed of copper.

Fourth Embodiment

A fourth embodiment of the present invention will now be described with reference to FIGS. 24 and 25.

The fourth embodiment is configured by changing the formation of the low thermal conductive film 5 in the cylinder liner 2 according to the first embodiment in the following manner. The cylinder liner 2 according to the fourth embodiment is the same as that of the first embodiment except for the configuration described below.

Formation of Film

Figure 24:
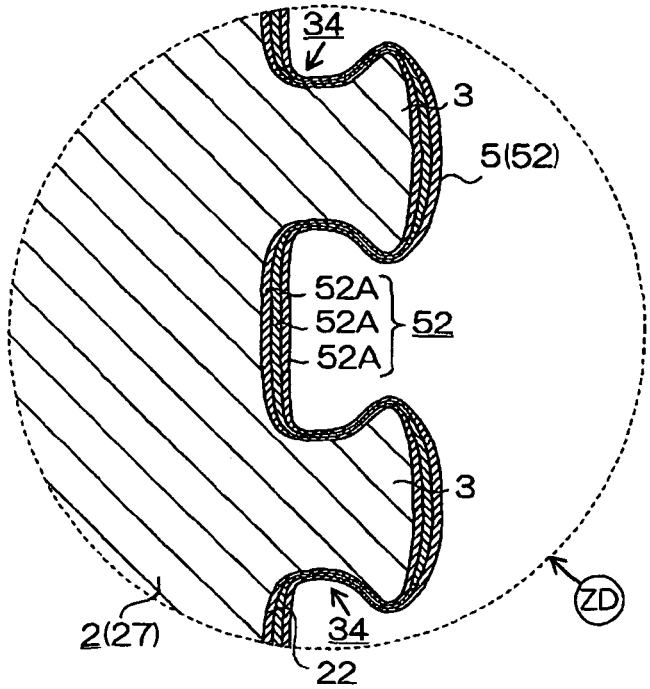
FIG. 24 is an enlarged cross-sectional view of a cylinder liner according to a fourth embodiment of the present invention, showing encircled part ZD of FIG. 6A.

FIG. 24 is an enlarged view showing encircled part ZD of FIG. 6A. In the cylinder liner 2, a low thermal conductive film 5 is formed on a liner outer circumferential surface 22 of a low temperature liner portion 27 in the cylinder liner 2.

The low thermal conductive film 5 is formed of a sprayed layer 52 of an iron based material. The sprayed layer 52 is formed by laminating a plurality of thin sprayed layers 52A. The sprayed layer 52 (the thin sprayed layers 52A) contains oxides and pores.

Bonding State of Cylinder Block and Low Temperature Liner Portion

Figure 25:
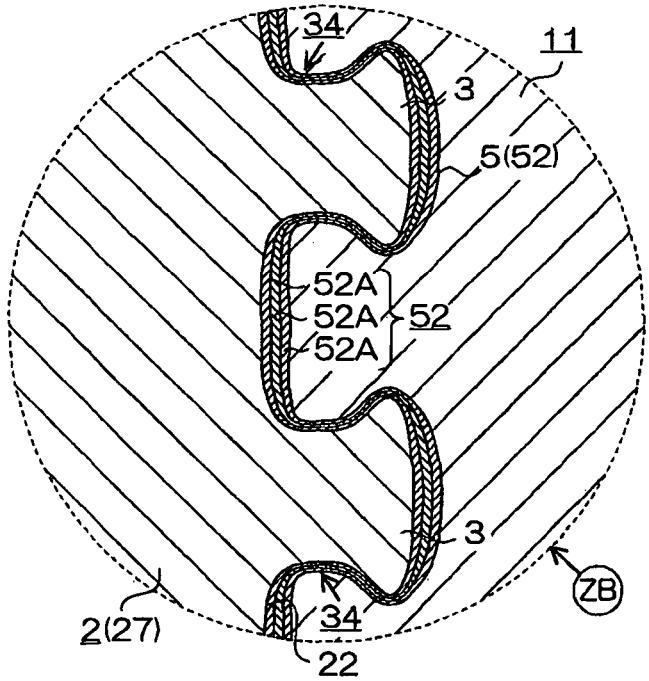
FIG. 25 is an enlarged cross-sectional view of the cylinder liner according to the fourth embodiment, showing encircled part ZB of FIG. 1.

FIG. 25 is a cross-sectional view of encircled part ZB of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the low thermal conductive film 5 in between.

Since the low thermal conductive film 5 is formed of a sprayed layer containing a number of layers of oxides and pores, the cylinder block 11 and the low thermal conductive film 5 are mechanically bonded to each other in a state of low thermal conductivity.

In the engine 1, since the cylinder block 11 and the low temperature liner portion 27 are bonded to each other in this state, the advantages (A) and (B) in "[2] Bonding State of Low Temperature Liner Portion" of the first embodiment are obtained.

Method for Producing Film

In the present embodiment, the low thermal conductive film 5 is formed by arc spraying. The low thermal conductive film 5 may be formed through the following procedure.

[1] Molten wire is sprayed onto the liner outer circumferential surface 22 by an arc spraying device to form a thin sprayed layer 52A.

[2] After forming one thin sprayed layer 52A, another thin sprayed layer 52A is formed on the first thin sprayed layer 52A.

[3] The process [2] is repeated until the low thermal conductive film 5 of a desired thickness is formed.

Advantages of Fourth Embodiment

In addition to the advantages (1) to (14) in the first embodiment, the cylinder liner 2 of the fourth embodiment provides the following advantage.

(18) In the cylinder liner 2 of the present embodiment, the sprayed layer 52 is formed of a plurality of thin sprayed layers 52A. Accordingly, a number of layers of oxides are formed in the sprayed layer 52. Thus, the thermal conductivity between the cylinder block 11 and the low temperature liner portion 27 is further reduced.

Fifth Embodiment

A fifth embodiment of the present invention will now be described with reference to FIGS. 26 and 27.

The fifth embodiment is configured by changing the formation of the low thermal conductive film 5 in the cylinder liner 2 according to the first embodiment in the following manner. The cylinder liner 2 according to the fifth embodiment is the same as that of the first embodiment except for the configuration described below.

Formation of Film

Figure 26:
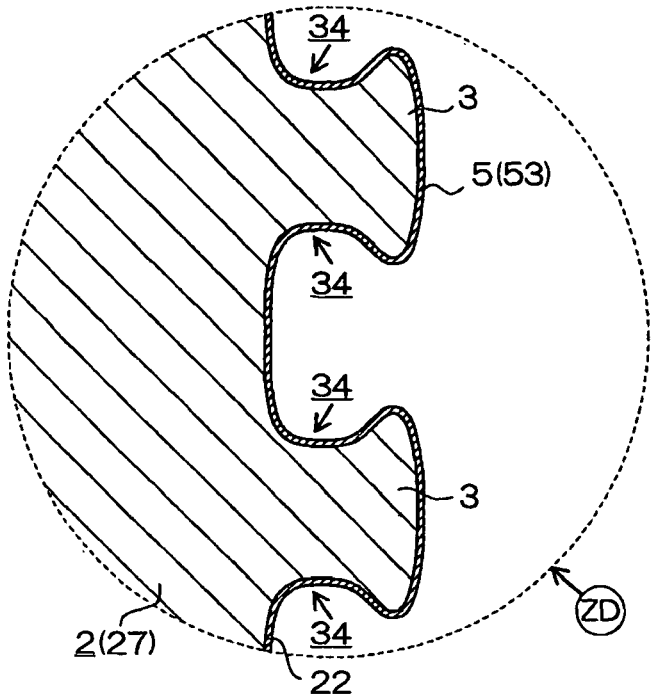
FIG. 26 is an enlarged cross-sectional view of a cylinder liner according to a fifth embodiment of the present invention, showing encircled part ZD of FIG. 6A.

FIG. 26 is an enlarged view showing encircled part ZD of FIG. 6A. In the cylinder liner 2, a low thermal conductive film 5 is formed on a liner outer circumferential surface 22 of a low temperature liner portion 27 in the cylinder liner 2. The low thermal conductive film 5 is formed of an oxide layer 53.

Bonding State of Cylinder Block and Low Temperature Liner Portion

Figure 27:
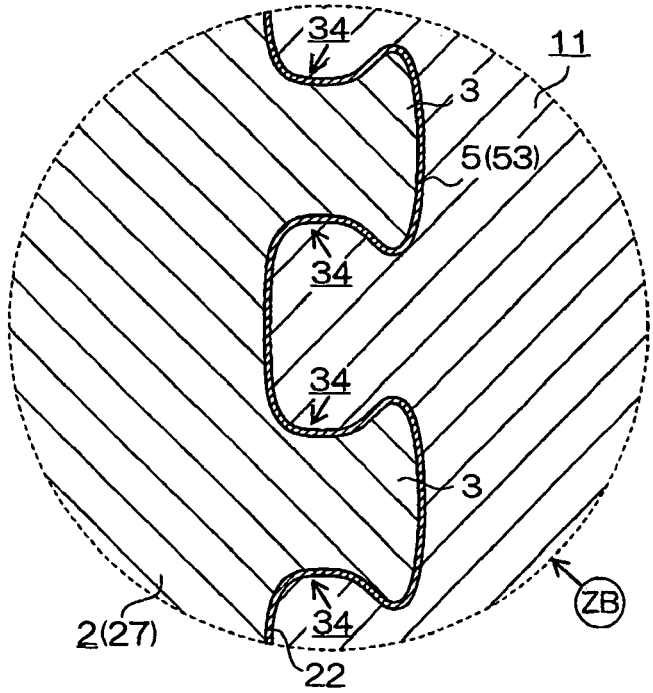
FIG. 27 is an enlarged cross-sectional view of the cylinder liner according to the fifth embodiment, showing encircled part ZB of FIG. 1.

FIG. 27 is a cross-sectional view of encircled part ZB of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the low thermal conductive film 5 in between.

Since the low thermal conductive film 5 is formed of oxides, the cylinder block 11 and the low thermal conductive film 5 are mechanically bonded to each other in a state of low thermal conductivity.

In the engine 1, since the cylinder block 11 and the low temperature liner portion 27 are bonded to each other in this state, the advantages (A) and (B) in "[2] Bonding State of Low Temperature Liner Portion" of the first embodiment are obtained.

Method for Producing Film

In the present embodiment, the low thermal conductive film 5 is formed by high-frequency heating. The low thermal conductive film 5 may be formed through the following procedure.

[1] The low temperature liner portion 27 is heated by a high frequency heating device.

[2] Heating is continued until the oxide layer 53 of a predetermined thickness is formed on the liner outer circumferential surface 22.

According to this method, heating of the low temperature liner portion 27 melts the distal end 32 of each projection 3. As a result, an oxide layer 53 is thicker at the distal end 32 than in other portions. Accordingly, the heat insulation property about the distal end 32 of the projection 3 is improved. Also, the low thermal conductive film 5 is formed to have a sufficient thickness at the constriction 33 of each projection 3. Therefore, the heat insulation property about the constriction 33 is improved.

Advantages of Fifth Embodiment

In addition to the advantages (1) to (14) in the first embodiment, the cylinder liner 2 of the fifth embodiment provides the following advantage.

(19) In the cylinder liner 2 of the present embodiment, the low thermal conductive film 5 is formed by heating the cylinder liner 2. Since no additional material is required to form the low thermal conductive film 5 is needed, effort and costs for material control are reduced.

Sixth Embodiment

A sixth embodiment of the present invention will now be described with reference to FIGS. 28 and 29.

The sixth embodiment is configured by changing the formation of the low thermal conductive film 5 in the cylinder liner 2 according to the first embodiment in the following manner. The cylinder liner 2 according to the sixth embodiment is the same as that of the first embodiment except for the configuration described below.

Formation of Film

Figure 28:
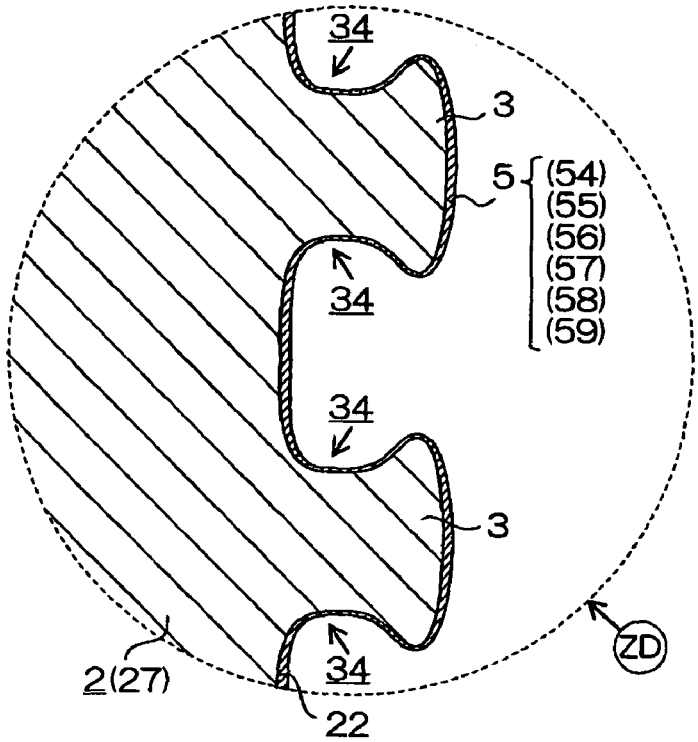
FIG. 28 is an enlarged cross-sectional view of a cylinder liner according to sixth to ninth embodiments of the present invention, showing encircled part ZD of FIG. 6A.

FIG. 28 is an enlarged view showing encircled part ZD of FIG. 6A. In the cylinder liner 2, a low thermal conductive film 5 is formed on a liner outer circumferential surface 22 of a low temperature liner portion 27 in the cylinder liner 2. The low thermal conductive film 5 is formed of a mold release agent layer 54, which is a layer of mold release agent for die casting.

When forming the mold release agent layer 54, for example, the following mold release agents may be used.

[11] A mold release agent obtained by compounding vermiculite, Hitasol, and water glass.

[2] A mold release agent obtained by compounding a liquid material, a major component of which is silicon, and water glass.

Bonding State of Cylinder Block and Low Temperature Liner Portion

Figure 29:
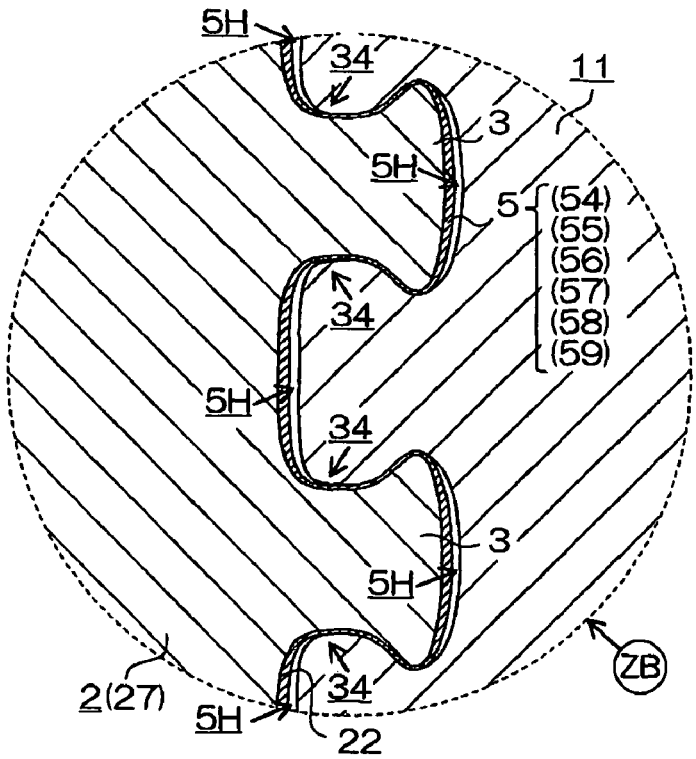
FIG. 29 is an enlarged cross-sectional view of the cylinder liner according to the sixth to ninth embodiments, showing encircled part ZB of FIG. 1.

FIG. 29 is a cross-sectional view of encircled part ZB of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the low thermal conductive film 5 in between.

Since the low thermal conductive film 5 is formed of a mold release agent, which has a low adhesion with the cylinder block 11, the cylinder block 11 and the low thermal conductive film 5 are bonded to each other with gaps 5H. When producing the cylinder block 11, the casting material is solidified in a state where sufficient adhesion between the casting material and the mold release agent layer 54 is not established at several portions. Accordingly, the gaps 5H are created between the cylinder block 11 and the mold release agent layer 54.

In the engine 1, since the cylinder block 11 and the low temperature liner portion 27 are bonded to each other in this state, the advantages (A) and (B) in "[2] Bonding State of Low Temperature Liner Portion" of the first embodiment are obtained.

Advantages of Sixth Embodiment

In addition to the advantages (1) to (14) in the first embodiment, the cylinder liner 2 of the sixth embodiment provides the following advantage.

(20) In the cylinder liner 2 of the present embodiment, the low thermal conductive film 5 is formed by using a mold release agent for die casting. Therefore, when forming the low thermal conductive film 5, the mold release agent for die casting that is used for producing the cylinder block 11 or the material for the agent can be used. Thus, the number of producing steps and costs are reduced.

Seventh Embodiment

A seventh embodiment of the present invention will now be described with reference to FIGS. 28 and 29.

The seventh embodiment is configured by changing the formation of the low thermal conductive film 5 in the cylinder liner 2 according to the first embodiment in the following manner. The cylinder liner 2 according to the seventh embodiment is the same as that of the first embodiment except for the configuration described below.

Formation of Film

FIG. 28 is an enlarged view showing encircled part ZD of FIG. 6A. In the cylinder liner 2, a low thermal conductive film 5 is formed on a liner outer circumferential surface 22 of a low temperature liner portion 27 in the cylinder liner 2.

The low thermal conductive film 5 is formed of a mold wash layer 55, which is a layer of mold wash for the centrifugal casting mold. When forming the mold wash layer 55, for example, the following mold washes may be used.

[1] A mold wash containing diatomaceous earth as a major component.

[2] A mold wash containing graphite as a major component.

Bonding State of Cylinder Block and Low Temperature Liner Portion

FIG. 29 is a cross-sectional view of encircled part ZB of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the low thermal conductive film 5 in between.

Since the low thermal conductive film 5 is formed of a mold wash, which has a low adhesion with the cylinder block 11, the cylinder block 11 and the low thermal conductive film 5 are bonded to each other with gaps 5H. When producing the cylinder block 11, the casting material is solidified in a state where sufficient adhesion between the casting material and the mold wash layer 55 is not established at several portions. Accordingly, the gaps 5H are created between the cylinder block 11 and the mold wash layer 55.

In the engine 1, since the cylinder block 11 and the low temperature liner portion 27 are bonded to each other in this state, the advantages (A) and (B) in "[2] Bonding State of Low Temperature Liner Portion" of the first embodiment are obtained.

Advantages of Seventh Embodiment

In addition to the advantages (1) to (14) in the first embodiment, the cylinder liner 2 of the seventh embodiment provides the following advantage.

(21) In the cylinder liner 2 of the present embodiment, the low thermal conductive film 5 is formed by using a mold wash for centrifugal casting. Therefore, when forming the low thermal conductive film 5, the mold wash for centrifugal casting that is used for producing the cylinder liner 2 or the material for the mold was can be used. Thus, the number of producing steps and costs are reduced.

Eighth Embodiment

An eighth embodiment of the present invention will now be described with reference to FIGS. 28 and 29.

The eighth embodiment is configured by changing the formation of the low thermal conductive film 5 in the cylinder liner 2 according to the first embodiment in the following manner. The cylinder liner 2 according to the eighth embodiment is the same as that of the first embodiment except for the configuration described below.

Formation of Film

FIG. 28 is an enlarged view showing encircled part ZD of FIG. 6A. In the cylinder liner 2, a low thermal conductive film 5 is formed on a liner outer circumferential surface 22 of a low temperature liner portion 27 in the cylinder liner 2.

The low thermal conductive film 5 is formed of a low adhesion agent layer 56. The low adhesion agent refers to a liquid material prepared using a material having a low adhesion with the cylinder block 11. When forming the low adhesion agent layer 56, for example, the following low adhesion agents may be used.

[1] A low adhesion agents obtained by compounding graphite, water glass, and water.

[2] A low adhesion agent obtained by compounding boron nitride and water glass.

Bonding State of Cylinder Block and Low Temperature Liner Portion

FIG. 29 is a cross-sectional view of encircled part ZB of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the low thermal conductive film 5 in between.

Since the low thermal conductive film 5 is formed of a low adhesion agent, which has a low adhesion with the cylinder block 11, the cylinder block 11 and the low thermal conductive film 5 are bonded to each other with gaps 5H. When producing the cylinder block 11, the casting material is solidified in a state where sufficient adhesion between the casting material and the low adhesion agent layer 56 is not established at several portions. Accordingly, the gaps 5H are created between the cylinder block 11 and the low adhesion agent layer 56.

In the engine 1, since the cylinder block 11 and the low temperature liner portion 27 are bonded to each other in this state, the advantages (A) and (B) in "[2] Bonding State of Low Temperature Liner Portion" of the first embodiment are obtained.

Method for Producing Film

A method for producing the low thermal conductive film 5 will be described.

In the present embodiment, the low thermal conductive film 5 is formed by coating and drying the low adhesion agent. The low thermal conductive film 5 may be formed through the following procedure.

[1] The cylinder liner 2 is placed for a predetermined period in a furnace that is heated to a predetermined temperature so as to be preheated.

[2] The cylinder liner 2 is immersed in a liquid low adhesion agent in a container so that the liner outer circumferential surface 22 is coated with the low adhesion agent.

[3] After step [2], the cylinder liner 2 is placed in the furnace used in step [1] so that the low adhesion agent is dried.

[4] Steps [1] to [3] are repeated until the low adhesion agent layer 56, which is formed through drying, has a predetermined thickness.

Advantages of Eighth Embodiment

The cylinder liner according to the eighth embodiment provides advantages similar to the advantages (1) to (14) in the first embodiment.

Modifications of Eighth Embodiment

The above illustrated eighth embodiment may be modified as shown below.

As the low adhesive agent, the following agents may be used.

(a) A low adhesion agent obtained by compounding graphite and organic solvent.

(b) A low adhesion agent obtained by compounding graphite and water.

(c) A low adhesion agent having boron nitride and inorganic binder as major components, or a low adhesion agent having boron nitride and organic binder as major components.

Ninth Embodiment

A ninth embodiment of the present invention will now be described with reference to FIGS. 28 and 29.

The ninth embodiment is configured by changing the formation of the low thermal conductive film 5 in the cylinder liner 2 according to the first embodiment in the following manner. The cylinder liner 2 according to the ninth embodiment is the same as that of the first embodiment except for the configuration described below.

Formation of Film

FIG. 28 is an enlarged view showing encircled part ZD of FIG. 6A. In the cylinder liner 2, a low thermal conductive film 5 is formed on a liner outer circumferential surface 22 of a low temperature liner portion 27 in the cylinder liner 2. The low thermal conductive film 5 is formed of a metallic paint layer 57.

Bonding State of Cylinder Block and Low Temperature Liner Portion

FIG. 29 is a cross-sectional view of encircled part ZB of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the low thermal conductive film 5 in between.

Since the low thermal conductive film 5 is formed of a metallic paint, which has a low adhesion with the cylinder block 11, the cylinder block 11 and the low thermal conductive film 5 are bonded to each other with gaps 5H. When producing the cylinder block 11, the casting material is solidified in a state where sufficient adhesion between the casting material and the metallic paint layer 57 is not established at several portions. Accordingly, the gaps 5H are created between the cylinder block 11 and the metallic paint layer 57.

In the engine 1, since the cylinder block 11 and the low temperature liner portion 27 are bonded to each other in this state, the advantages (A) and (B) in "[2] Bonding State of Low Temperature Liner Portion" of the first embodiment are obtained.

Advantages of Ninth Embodiment

The cylinder liner 2 according to the ninth embodiment provides advantages similar to the advantages (1) to (14) in the first embodiment.

Tenth Embodiment

A tenth embodiment of the present invention will now be described with reference to FIGS. 28 and 29.

The tenth embodiment is configured by changing the formation of the low thermal conductive film 5 in the cylinder liner 2 according to the first embodiment in the following manner. The cylinder liner 2 according to the tenth embodiment is the same as that of the first embodiment except for the configuration described below.

Formation of Film

FIG. 28 is an enlarged view showing encircled part ZD of FIG. 6A. In the cylinder liner 2, a low thermal conductive film 5 is formed on a liner outer circumferential surface 22 of a low temperature liner portion 27 in the cylinder liner 2. The low thermal conductive film 5 is formed of a high-temperature resin layer 58.

Bonding State of Cylinder Block and Low Temperature Liner Portion

FIG. 29 is a cross-sectional view of encircled part ZB of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the low thermal conductive film 5 in between.

Since the low thermal conductive film 5 is formed of a high-temperature resin, which has a low adhesion with the cylinder block 11, the cylinder block 11 and the low thermal conductive film 5 are bonded to each other with gaps 5H. When producing the cylinder block 11, the casting material is solidified in a state where sufficient adhesion between the casting material and the high-temperature resin layer 58 is not established at several portions. Accordingly, the gaps 5H are created between the cylinder block 11 and the high-temperature resin layer 58.

In the engine 1, since the cylinder block 11 and the low temperature liner portion 27 are bonded to each other in this state, the advantages (A) and (B) in "[2] Bonding State of Low Temperature Liner Portion" of the first embodiment are obtained.

Advantages of Tenth Embodiment

The cylinder liner 2 according to the tenth embodiment provides advantages similar to the advantages (1) to (14) in the first embodiment.

Eleventh Embodiment

An eleventh embodiment of the present invention will now be described with reference to FIGS. 28 and 29.

The eleventh embodiment is configured by changing the formation of the low thermal conductive film 5 in the cylinder liner 2 according to the first embodiment in the following manner. The cylinder liner 2 according to the eleventh embodiment is the same as that of the first embodiment except for the configuration described below.

Formation of Film

FIG. 28 is an enlarged view showing encircled part ZD of FIG. 6A. In the cylinder liner 2, a low thermal conductive film 5 is formed on a liner outer circumferential surface 22 of a low temperature liner portion 27 in the cylinder liner 2.

The low thermal conductive film 5 is formed of a chemical conversion treatment layer 59, which is a layer formed through chemical conversion treatment. As the chemical conversion treatment layer 59, the following layers maybe formed.

[1] A chemical conversion treatment layer of phosphate.

[2] A chemical conversion treatment layer of ferrosoferric oxide.

Bonding State of Cylinder Block and Low Temperature Liner Portion

FIG. 29 is a cross-sectional view of encircled part ZB of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the low thermal conductive film 5 in between.

Since the low thermal conductive film 5 is formed of a phosphate film or a ferrosoferric oxide, which have a low adhesion with the cylinder block 11, the cylinder block 11 and the low thermal conductive film 5 are bonded to each other with a plurality of gaps 5H. When producing the cylinder block 11, the casting material is solidified in a state where sufficient adhesion between the casting material and the chemical conversion treatment layer 59 is not established at several portions. Accordingly, the gaps 5H are created between the cylinder block 11 and the chemical conversion treatment layer 59.

In the engine 1, since the cylinder block 11 and the low temperature liner portion 27 are bonded to each other in this state, the advantages (A) and (B) in "[2] Bonding State of Low Temperature Liner Portion" of the first embodiment are obtained.

Advantages of Eleventh Embodiment

In addition to the advantages (1) to (14) in the first embodiment, the cylinder liner 2 of the eleventh embodiment provides the following advantage.

(22) In the cylinder liner 2 of the present embodiment, the low thermal conductive film 5 is formed by chemical conversion treatment. The low thermal conductive film 5 is formed to have a sufficient thickness at the constriction 33 of each projection 3. Therefore, the gaps 5H are easily formed about the constrictions 33. That is, the heat insulation property about the constriction 33 is improved.

(23) Also, since the low thermal conductive film 5 is formed with a small variation in the film thickness TP, the cylinder wall temperature TW is accurately adjusted by changing the film thickness TP.

Twelfth Embodiment

A twelfth embodiment of the present invention will now be described with reference to FIG. 30.

The twelfth embodiment is configured by changing the formation of the high thermal conductive film 4 and the low thermal conductive film 5 in the cylinder liner 2 according to the first embodiment in the following manner. The cylinder liner 2 according to the twelfth embodiment is the same as that of the first embodiment except for the configuration described below.

Formation of Film

Figure 30:
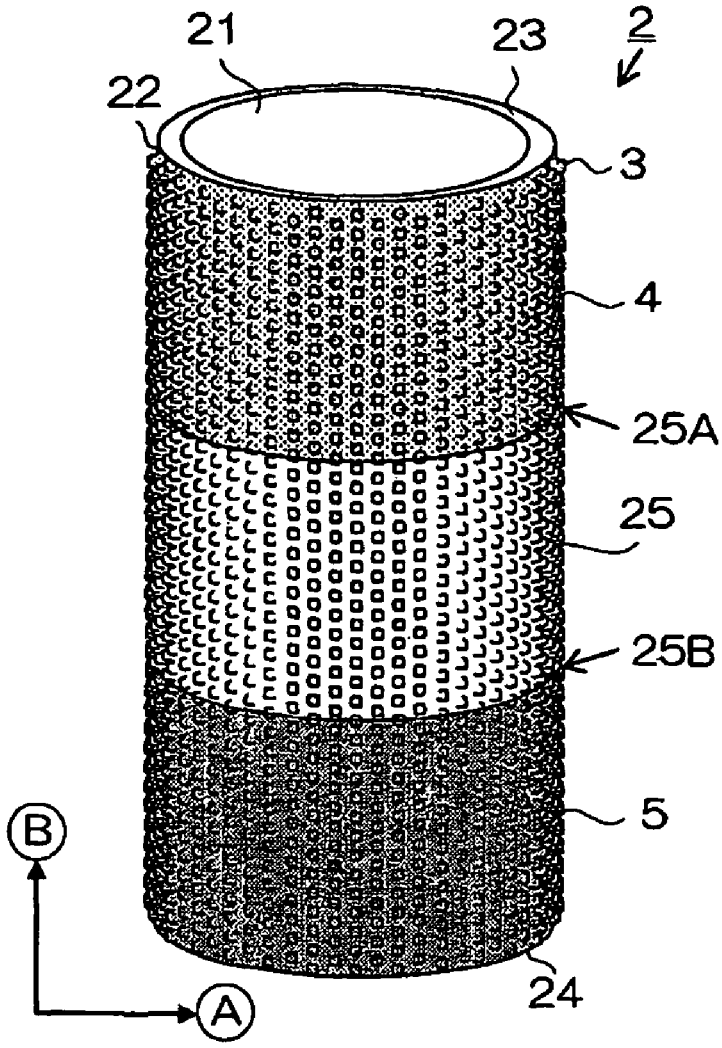
FIG. 30 is a perspective view illustrating a cylinder liner according to a tenth embodiment of the present invention.

FIG. 30 is a perspective view illustrating the cylinder liner 2. On the liner outer circumferential surface 22 of the cylinder liner 2, a high thermal conductive film 4 is formed in an area from the liner upper end 23 to a first line 25A, which is an upper end of the liner middle portion 25. The high thermal conductive film 4 is formed along the entire circumferential direction.

On the liner outer circumferential surface 22 of the cylinder liner 2, a low thermal conductive film 5 is formed in an area from the liner lower end 24 to a second line 25B, which is a lower end of the liner middle portion 25. The low thermal conductive film 5 is formed along the entire circumferential direction.

On the liner outer circumferential surface 22, an area without the high thermal conductive film 4 and the low thermal conducive film 5 is provided from the first line 25A to the second line 25B the first line 25A is located closer to the liner upper end 23 than the second line 25B is.

Advantages of Twelfth Embodiment

In addition to the advantages (1) to (14) in the first embodiment, the cylinder liner 2 of the twelfth embodiment provides the following advantage.

(24) In the cylinder liner 2 of the present embodiment, the thermal conductivity between the cylinder block 11 and the cylinder liner 2 is discretely reduced from the liner upper end 23 to the liner lower end 24. This suppresses abrupt changes in the cylinder wall temperature TW.

Modifications of Twelfth Embodiment

The above illustrated twelfth embodiment may be modified as shown below.

The twelfth embodiment may be applied to the second to eleventh embodiments.

Thirteenth Embodiment

The thirteenth embodiment will now be described.

The thirteenth embodiment is configured by changing the structure of the cylinder liner 2 according to the first embodiment in the following manner. The cylinder liner 2 according to the thirteenth embodiment is the same as that of the first embodiment except for the configuration described below.

Structure of Cylinder Liner

A liner thickness TL, which is the thickness of the cylinder liner 2 of the present embodiment, is set in the following manner. That is, the liner thickness TL in the low temperature liner portion 27 is set greater than the liner thickness TL in the high temperature liner portion 26. Also, the liner thickness TL is set to gradually increase from the liner upper end 23 to the liner lower end 24.

Advantages of Thirteenth Embodiment

In addition to the advantages (1) to (14) in the first embodiment, the cylinder liner 2 of the thirteenth embodiment provides the following advantage.

(25) According to the cylinder liner 2 of the present embodiment, the thermal conductivity between the cylinder block 11 and the high temperature liner portion 26 is increased while the thermal conductivity between the cylinder block 11 and the low temperature liner portion 27 is reduced. This further reduces the cylinder wall temperature difference ΔTW.

Modifications of Thirteenth Embodiment

The above illustrated thirteenth embodiment may be modified as shown below.

The thirteenth embodiment may be applied to the second to twelfth embodiments.

In the thirteenth embodiment, the liner thickness TL in the low temperature liner portion 27 may be set greater than the liner thickness TL in the high temperature liner portion 26, and the liner thickness TL may be set constant in each of these sections.

Other than the cylinder liner 2, the setting of the liner thickness TL according to the thirteenth embodiment may be applied to any type of cylinder liner. For example, the setting of the cylinder liner thickness TL of the present embedment may be applied to a cylinder liner that meets at least one of the following conditions (A) and (B).

(A) A cylinder liner on which the high thermal conductive film 4 and the low thermal conductive film 5 are not formed.

(B) A cylinder liner on which the projections 3 are not formed.

Other Embodiments

The above embodiments may be modified as follows.

The following combinations of the high thermal conductive films 4 and the low thermal conductive films 5 of the above embodiments are possible.

(i) A combination of the high thermal conductive film 4 of the second embodiment and the low thermal conductive film 5 of any of the fourth to eleventh embodiments.

(ii) A combination of the high thermal conductive film 4 of the third embodiment and the low thermal conductive film 5 of any of the fourth to eleventh embodiments.

At least one of the twelfth and thirteenth embodiments may be applied to the embodiments (i) and (ii).

The method for forming the high thermal conductive film 4 is not limited to the methods shown in the above embodiments (spraying, shot coating, and plating). Any other method may be applied as necessary.

The method for forming the low thermal conductive film 5 is not limited to the methods shown in the above embodiments (spraying, coating, resin coating, and chemical conversion treatment). Any other method may be applied as necessary.

In the above illustrated embodiments, the selected ranges of the first area ratio SA and the second area ratio SB are set be in the selected ranges shown in Table 1. However, the selected ranges may be changed as shown below.

The first area ratio SA: 10%-30%

The second area ratio SB: 20%-45%

This setting increases the liner bond strength and the filling factor of the casting material to the spaces between the projections 3.

In the above embodiments, the selected range of the standard projection height HP is set to a range from 0.5 mm to 1.0 mm. However, the selected range may be changed as shown below. That is, the selected range of the standard projection height HP may be set to a range from 0.5 mm to 1.5 mm.

In each of the above embodiments, the film thickness TP of the high thermal conductive film 4 may be gradually increased from the liner upper end 23 to the liner middle portion 25. In this case, the thermal conductivity between the cylinder block 11 and an upper portion of the cylinder liner 2 decreases from the liner upper end 23 to the liner middle portion 25. Thus, the difference of the cylinder wall temperature TW in the upper portion of the cylinder liner 2 along the axial direction is reduced.

In each of the above embodiments, the film thickness TP of the low thermal conductive film 5 may be gradually decreased from the liner lower end 24 to the liner middle portion 25. In this case, the thermal conductivity between the cylinder block 11 and a lower portion of the cylinder liner 2 increases from the liner lower end 24 to the liner middle portion 25. Thus, the difference of the cylinder wall temperature TW in the lower portion of the cylinder liner 2 along the axial direction is reduced.

In the above embodiments, the low thermal conductive film 5 is formed along the entire circumference of the cylinder liner 2. However, the position of the low thermal conductive film 5 may be changed as shown below. That is, with respect to the direction along which the cylinders 13 are arranged, the film 5 may be omitted from sections of the liner outer circumferential surfaces 22 that face the adjacent cylinder bores 15. In other words, the low thermal conductive films 5 may be formed in sections except for sections of the liner outer circumferential surfaces 2 that face the liner outer circumferential surfaces 2 of the adjacent cylinder liners 2 with respect to the arrangement direction of the cylinders 13. This configuration provides the following advantages (i) and (ii).

(i) Heat from each adjacent pair of the cylinders 13 is likely to be confined in a section between the corresponding cylinder bores 15. Thus, the cylinder wall temperature TW in this section is likely to be higher than that in the sections other than the sections between the cylinder bores 15. Therefore, the above described modification of the formation of the low heat conductive film 5 prevents the cylinder wall temperature TW in a section facing the adjacent the cylinder bores 15 with respect to the circumferential direction of the cylinders 13 is prevented from excessively increased.

(ii) In each cylinder 13, since the cylinder wall temperature TW varies along the circumferential direction, the amount of deformation of the cylinder bore 15 varies along the circumferential direction. Such variation in deformation amount of the cylinder bore 15 increases the friction of the piston, which degrades the fuel consumption rate. When the above configuration of the formation of the film 5 is adopted, the thermal conductivity is lowered in sections other than the sections facing the adjacent cylinder bores 15 with respect to the circumferential direction of the cylinder 13. On the other hand, the thermal conductivity of the sections facing the adjacent cylinder bores 15 is the same as that of conventional engines. This reduces the difference between the cylinder wall temperature TW in the sections other than the sections facing the adjacent cylinder bores 15 and the cylinder wall temperature TW in the sections facing the adjacent the cylinder bores 15. Accordingly, variation of deformation of each cylinder bore 15 along the circumferential direction is reduced (deformation amount is equalized). This reduces the friction of the piston and thus improves the fuel consumption rate.

The configuration of the formation of the high thermal conductive film 4 according to the above embodiments may be modified as shown below. That is, the high thermal conductive film 4 may be formed of any material as long as at least one of the following conditions (A) and (B) is met.

(A) The thermal conductivity of the high thermal conductive film 4 is greater than that of the cylinder liner 2.

(B) The thermal conductivity of the high thermal conductive film 4 is greater than that of the cylinder block 11.

The configuration of the formation of the low thermal conductive film 5 according to the above embodiments may be modified as shown below. That is, the low thermal conductive film 5 may be formed of any material as long as at least one of the following conditions (A) and (B) is met.

(A) The thermal conductivity of the low thermal conductive film 5 is smaller than that of the cylinder liner 2.

(B) The thermal conductivity of the low thermal conductive film 5 is smaller than that of the cylinder block 11.

In the above embodiments, the high thermal conductive film 4 and the low thermal conductive film 5 are formed on the cylinder liner 2 with the projections 3 the related parameters of which are in the selected ranges of Table 1. However, the high thermal conductive film 4 and the low thermal conductive film 5 may be formed on any cylinder liner as long as the projections 3 are formed on it.

In the above embodiments, the high thermal conductive film 4 and the low thermal conductive film 5 are formed on the cylinder liner 2 on which the projections 3 are formed. However, the high thermal conductive film 4 and the low thermal conductive film 5 may be formed on a cylinder liner on which projections without constrictions are formed.

In the above embodiments, the high thermal conductive film 4 and the low thermal conductive film 5 are formed on the cylinder liner 2 on which the projections 3 are formed. However, the high thermal conductive film 4 and the low thermal conductive film 5 may be formed on a cylinder liner on which no projections are formed.

In the above embodiment, the cylinder liner of the present embodiment is applied to an engine made of an aluminum alloy. However, the cylinder liner of the present invention may be applied to an engine made of, for example, a magnesium alloy. In short, the cylinder liner of the present invention may be applied to any engine that has a cylinder liner. Even in such case, the advantages similar to those of the above embodiments are obtained if the invention is embodied in a manner similar to the above embodiments.

The invention claimed is:

1. A cylinder liner for insert casting used in a cylinder block, comprising an upper portion, a middle portion and a lower portion with respect to an axial direction of the cylinder liner, wherein a high thermal conductive film is formed on an outer circumferential surface of the cylinder liner to extend over the upper portion but not to extend over the lower portion, and a low thermal conductive film is formed on the outer circumferential surface of the cylinder liner to extend over the lower portion but not to extend over the upper portion and does not extend over the high thermal conductive film at the upper portion, and wherein the high thermal conductive film does not extend over the low thermal conductive film at the lower portion, wherein the high and low thermal conductive films abut, but do not overlap each other.

2. The cylinder liner according to claim 1, wherein the high thermal conductive film functions to increase adhesion of the cylinder liner to the cylinder block.

3. The cylinder liner according to claim 1, wherein the high thermal conductive film is formed of a sprayed layer of a metal material.

4. The cylinder liner according to claim 1, wherein the high thermal conductive film is formed of a shot coating layer of a metal material.

5. The cylinder liner according to claim 1, wherein the high thermal conductive film is formed of a plated layer of a metal material.

6. The cylinder liner according to claim 1, wherein the high thermal conductive film is allowed to be metallurgically bonded to the cylinder block.

7. The cylinder liner according to claim 1, wherein the high thermal conductive film has a melting point that is lower than or equal to a temperature of a molten casting material used in the insert casting of the cylinder liner with the cylinder block.

8. The cylinder liner according to claim 1, wherein the high thermal conductive film has a higher thermal conductivity than that of the cylinder liner.

9. The cylinder liner according to claim 1, wherein the high thermal conductive film has a higher thermal conductivity than that of the cylinder block.

10. The cylinder liner according to claim 1, wherein the low thermal conductive film functions to form gaps between the cylinder block and the cylinder liner.

11. The cylinder liner according to claim 1, wherein the low thermal conductive film functions to lower the adhesion of the cylinder liner to the cylinder block.

12. The cylinder liner according to claim 1, wherein the low thermal conductive film is formed of a mold release agent for die casting.

13. The cylinder liner according to claim 1, wherein the low thermal conductive film is formed of a mold wash for centrifugal casting.

14. The cylinder liner according to claim 1, wherein the low thermal conductive film is formed of a low adhesion agent containing graphite as a major component.

15. The cylinder liner according to claim 1, wherein the low thermal conductive film is formed of a low adhesion agent containing boron nitride as a major component.

16. The cylinder liner according to claim 1, wherein the low thermal conductive film is formed of a metallic paint.

17. The cylinder liner according to claim 1, wherein the low thermal conductive film is formed of a high-temperature resin.

18. The cylinder liner according to claim 1, wherein the low thermal conductive film is formed of a chemical conversion treatment layer.

19. The cylinder liner according to claim 1, wherein the low thermal conductive film is formed of a sprayed layer of a ceramic material.

20. The cylinder liner according to claim 1, wherein the low thermal conductive film is formed of a sprayed layer of an iron based material, the sprayed layer having oxides and pores.

21. The cylinder liner according to claim 1, wherein the low thermal conductive film is formed of an oxide layer.

22. The cylinder liner according to claim 1, wherein the low thermal conductive film has a lower thermal conductivity than that of the cylinder block.

23. The cylinder liner according to claim 1, wherein the low thermal conductive film has a lower thermal conductivity than that of the cylinder liner.

24. The cylinder liner according to claim 1, wherein the thickness of the low thermal conductive film decreases as it gets farther from a lower end of the cylinder liner along the axial direction of the cylinder liner.

25. The cylinder liner according to claim 1, wherein the cylinder block has a plurality of cylinder bores, the cylinder liner being located in one of the cylinder bores, and wherein the low thermal conductive film is formed on the outer circumferential surface of the lower portion except for sections that face the adjacent cylinder bores.

26. The cylinder liner according to claim 1, wherein the high thermal conductive film begins at an upper end of the cylinder liner and reaches a first middle portion, the first middle portion being located in a center of the cylinder liner with respect to the axial direction, wherein the low thermal conductive film begins at a lower end of the cylinder liner and reaches a second middle portion, the second middle portion being located in a center of the cylinder liner with respect to the axial direction and closer to the lower end of the cylinder liner than the first middle portion is, and wherein neither of the high thermal conductive film nor the low thermal conductive film is formed between the first middle portion and the second middle portion.

27. The cylinder liner according to claim 1, wherein a thickness of the upper portion is less than a thickness of the lower portion.

28. The cylinder liner according to claim 1, wherein the outer circumferential surface of the cylinder liner has a plurality of projections each having a constricted shape.

29. The cylinder liner, according to claim 28, wherein the number of the projections is five to sixty per 1 $cm^2$ of the outer circumferential surface of the cylinder liner.

30. The cylinder liner according to claim 28, wherein the height of each projection is 0.5 to 1.5 mm.

31. The cylinder liner according to claim 28, wherein, in a contour diagram of the outer circumferential surface of the cylinder liner obtained by a three-dimensional laser measuring device, the ratio of the total area of regions each surrounded by a contour line representing a height of 0.4 mm to the area of the entire contour diagram is equal to or more than 10%.

32. The cylinder liner according to claim 28, wherein, in a contour diagram of the outer circumferential surface of the cylinder liner obtained by a three-dimensional laser measuring device, the ratio of the total area of regions each surrounded by a contour line representing a height of 0.2 mm to the area of the entire contour diagram is equal to or less than 55%.

33. The cylinder liner according to claim 28, wherein, in a contour diagram of the outer circumferential surface of the cylinder liner obtained by a three-dimensional laser measuring device, the ratio of the total area of regions each surrounded by a contour line representing a height of 0.4 mm to the area of the entire contour diagram is 10% to 50%.

34. The cylinder liner according to claim 28, wherein, in a contour diagram of the outer circumferential surface of the cylinder liner obtained by a three-dimensional laser measuring device, the ratio of the total area of regions each surrounded by a contour line representing a height of 0.2 mm to the area of the entire contour diagram is 20% to 55%.

35. The cylinder liner according to claim 28, wherein, in a contour diagram of the outer circumferential surface of the cylinder liner obtained by a three-dimensional laser measuring device, the area of each region surrounded by a contour line representing a height of 0.4 mm is 0.2 to 3.0 $mm^2$.

36. The cylinder liner according to claim 28, wherein a cross-section of each projection by a plane containing the contour line representing a height of 0.4 mm from the proximal end of the projection is independent from cross-sections of the other projections by the same plane.

* * * * *